US009074347B2

(12) United States Patent
Vigholm et al.

(10) Patent No.: US 9,074,347 B2
(45) Date of Patent: Jul. 7, 2015

(54) HYDRAULIC SYSTEM AND A WORKING MACHINE COMPRISING SUCH A HYDRAULIC SYSTEM

(75) Inventors: Bo Vigholm, Stora Sundby (SE); Andreas Ekvall, Hallstahammar (SE); Kim Heybroek, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 731 days.

(21) Appl. No.: 13/322,941

(22) PCT Filed: May 29, 2009

(86) PCT No.: PCT/SE2009/000282

§ 371 (c)(1),
(2), (4) Date: Dec. 12, 2011

(87) PCT Pub. No.: WO2010/138029

PCT Pub. Date: Dec. 2, 2010

(65) Prior Publication Data

US 2012/0067432 A1 Mar. 22, 2012

(51) Int. Cl.
*E02F 9/22* (2006.01)
*F15B 21/14* (2006.01)

(52) U.S. Cl.
CPC ..... *E02F 9/2217* (2013.01); *E02F 9/2292* (2013.01); *E02F 9/2296* (2013.01); *F15B 21/14* (2013.01); *F15B 2211/20546* (2013.01); *F15B 2211/3057* (2013.01); *F15B 2211/3111* (2013.01); *F15B 2211/6309* (2013.01); *F15B 2211/6313* (2013.01); *F15B 2211/6336* (2013.01); *F15B 2211/634* (2013.01); *F15B 2211/6346* (2013.01);

(Continued)

(58) Field of Classification Search
CPC ..... F15B 21/14; E02F 9/2217
USPC ..... 60/414, 464; 91/363 R
See application file for complete search history.

(56) References Cited

U.S. PATENT DOCUMENTS 5,713,144 A * 2/1998 Haraoka ..... 37/348
6,378,301 B2 * 4/2002 Endo et al. ..... 60/414
6,735,888 B2 * 5/2004 Green et al. ..... 37/348

(Continued)

FOREIGN PATENT DOCUMENTS

JP 2004138187 A2 5/2004
JP 2004324742 A2 11/2004

(Continued)

OTHER PUBLICATIONS

JP 200723989 A, Kayaba Ind Co Ltd, Sep. 20, 2007; (abstract).

(Continued)

*Primary Examiner* — Thomas E Lazo
(74) *Attorney, Agent, or Firm* — WRB-IP LLP

(57) ABSTRACT

A hydraulic system for a working machine includes at least one work function and a control valve unit for controlling hydraulic fluid to and from the work function, and a recovery unit connected to a return port of the control valve unit for recovering energy from the work function. The system further includes an arrangement for limiting the pressure of the hydraulic fluid at the return port, which pressure limiting arrangement has a pilot-operated valve adapted to set a maximum allowable pressure at the return port of the control valve unit. The pressure is variable by controlling the pilot-operated valve by a control unit.

30 Claims, 14 Drawing Sheets

(52) U.S. Cl.
CPC *F15B 2211/7121* (2013.01); *F15B 2211/7128* (2013.01); *F15B 2211/88* (2013.01)

(56) References Cited

U.S. PATENT DOCUMENTS

| | | | | |
|---|---|---|---|---|
| 7,448,208 | B2 * | 11/2008 | Montineri | 60/469 |
| 7,565,801 | B2 * | 7/2009 | Tozawa et al. | 60/414 |
| 7,634,911 | B2 * | 12/2009 | Brinkman | 60/414 |
| 8,336,305 | B2 * | 12/2012 | Matsuura et al. | 60/419 |
| 2008/0097673 | A1 * | 4/2008 | Tomita et al. | 701/50 |
| 2008/0317574 | A1 | 12/2008 | Moriya et al. | |

FOREIGN PATENT DOCUMENTS

| | | | |
|---|---|---|---|
| JP | 2007040393 | A2 | 2/2007 |
| JP | 2007263160 | A2 | 10/2007 |
| JP | 2007315514 | A2 | 12/2007 |
| JP | 2008275101 | A2 | 11/2008 |
| WO | WO 2006132031 | A1 * | 12/2006 |
| WO | WO 2008065983 | A1 * | 6/2008 |

OTHER PUBLICATIONS

JP 2007263157 A, Kayaba Ind Co Ltd, Oct. 11, 2007; (abstract).

International Search Report for corresponding International Application PCT/SE2009/000282.

Japanese Official Action (Sep. 25, 2013) from corresponding Japanese Application 2012-512999.

* cited by examiner

HYDRAULIC SYSTEM AND A WORKING MACHINE COMPRISING SUCH A HYDRAULIC SYSTEM

BACKGROUND AND SUMMARY

The present invention relates to a hydraulic system. The invention also relates to a working machine comprising the hydraulic system.

A working machine in the form of a wheel loader has a plurality of different work functions which are controlled hydraulically, such as lifting and tilting of an implement and steering (frame steering) of the working machine. The control of the respective work function is performed via hydraulic actuators; such as linear motors in the form of hydraulic cylinders.

Below, the invention will be described in connection with the operation of a wheel loader. This is a preferred, but by no means limiting application of the invention. The invention can also be utilized for other types of working machines or working vehicles having hydraulic work functions. It could for example also be an articulated hauler, a backhoe loader, an excavator, or an agricultural machine such as a tractor.

The present hydraulic systems are preferably of a load sensing type (L S systems). This means that the pump supplying the system with hydraulic oil senses the pressure (via a L S signal) from the actuated hydraulic cylinder (hydraulic cylinders). The pump then sets a pressure which is slightly higher than the pressure in the hydraulic cylinder. Thereby, a flow of hydraulic oil out to the hydraulic cylinder is obtained. A control valve (also called a manoeuvre valve) is placed between the pump and the hydraulic cylinder.

The magnitude of the flow to the hydraulic cylinder depends on how much the actuated control valve is modulated open.

In the present hydraulic systems of load sensing type, energy which could be recovered is lost. Some examples of energy losses which may arise will be described below.

An operation mode where an energy loss may arise is when lowering a work implement, such as a bucket or a container, wherein the intrinsic weight (and in some cases load) of the work implement drives the piston in the hydraulic cylinder. Here, a pressure drop usually occurs across the control valve, since the returned hydraulic oil is drained to tank, which in its turn results in an energy loss (heat). Another operation mode where an energy loss may arise is with so-called back up pressure. When the steering of the working machine is used, the returned hydraulic oil is pressurized with a back pressure of the mapitude of approx. 10-40 bar with the purpose of obtaining a stable steering without jerks. This back up pressure, in its turn, leads to energy losses. Another operation mode where energy loss may arise is during so called parallel operation of different work functions. In general, a single common pump is used for a plurality of work functions. These work functions may, however, require different pressures, meaning that the pump has to be adjusted according to the highest required pressure. This means that, during parallel operation of two work functions having different pressure requirements, the pressure has to be reduced for the work function requiring the lowest pressure. The pressure drop which arises across the control valve for the work function requiring the lowest pressure results in an energy loss, It is desirable to produce a hydraulic system of the kind defined by way of introduction, which system creates conditions for a more efficient operation of the hydraulic system, and/or of a working machine provided with such a hydraulic system, with respect to energy consumption.

Instead of having losses arising due to a pressure drop across the control valve unit (as described above), energy can be recovered with the recovery unit. Since the pressure limiting means comprises a pilot-operated valve adapted to set a maximum allowable pressure at the return port of the control valve unit, which pressure is variable by controlling the pilot-operated valve by means of a control unit, an upper limit for the amount of energy desired to be recovered from the work function can be selected.

The set maximum pressure also determines the smallest possible pressure drop across the control valve unit. A return flow of hydraulic oil from the work function will flow through the recovery unit and energy will be recovered as long as the recovery unit does not produce a higher back pressure than the set maximum allowable pressure. The invention creates conditions for controlling the energy recovery in a variable way depending on the actual operating mode. Within the range of the maximum allowable pressure, the pressure drop across the control valve unit will be determined by the resistance from the recovery unit. In many cases, the pressure drop across the control valve unit is preferably as small as possible in order to maximize the energy recovery, but sufficiently large to achieve the modulation of the requested return flow of hydraulic fluid. The recovery unit can, for example, be a hydraulic machine functioning as a hydraulic motor when recovering energy. The recovered energy can go directly to a consumer or be stored in a suitable manner.

Even though the recovery unit is adapted to the actual hydraulic system, in some cases it could happen that all energy which potentially can be recovered at a certain point in time cannot be stored or consumed instantaneously. In such a case, a certain amount of energy can still be emitted in a conventional manner in the form of heat resulting from a pressure drop across the control valve unit and/or the pilot-operated valve. In case only a limited energy recovery or no energy recovery at all is desirable in a certain situation, the pilot-operated valve can be controlled so that the maximum allowable pressure at the return port is low (relative to the pressure of the work function in question) or, in the latter case, so that the maximum allowable pressure at the return port is essentially negligible. If, on the other hand, it is desired to recover as much energy as possible, the pilot-operated valve can be controlled so that the maximum allowable pressure is high (of the same mapitude as, or higher than the pressure of the work function in question). In that case the recovery unit is controlled so that the desired recovery is obtained, at the same time as it is ensured that the pressure drop across the control valve unit is sufficiently large to achieve the modulation of the requested return flow of hydraulic fluid.

It should be pointed out that the expression "return port of the control valve unit" can include a separate outlet from a valve (if the control valve unit comprises a valve with an outlet or a return port), as well as a common connection point for two or more outlets of one or several valves (if the control valve unit, for example, comprises two control valves). The primary thing is that, by means of the pilot-operated valve, the maximum allowable pressure of the return flow downstream of the control valve unit can be controlled to the desired level.

The pilot-operated valve is preferably connected to the return port and connected in parallel with the recovery unit, which means that hydraulic fluid can be directed to the recovery unit and/or via the pilot-operated valve past the recovery unit and further for example to tank.

The pilot-operated valve is preferably electrically controllable and, furthermore, the maximum allowable pressure at the return port of the control valve unit is preferably continuously variable by means of the pilot-operated valve. By means of a control unit and a suitable software, the pressure at the return port of the control valve unit can be adjusted and adapted to the actual operating situation in order to optimize the energy recovery. An electrically controllable valve creates conditions for controlling the energy recovery in an accurate manner.

As described above, the pressure limiting means comprises a pilot-operated valve. This valve can, for example, be a pressure limiting valve or a proportional directional valve which, by means of a control unit and pressure sensors, functions as a pressure limiting valve.

The expression "pilot-operated" valve refers to a valve, the reference value of which (pressure or flow) is determined by an external signal (electric or hydraulic), preferably from a control unit. This in contrast to a valve which is direct acting, i.e. a valve which is adapted to respond to a specific condition (usually a pressure) in the system and which, accordingly, has a setting which is fixed in relation to the prevailing condition. For example, such a direct acting valve can have a given pressure level which is determined by a preloaded spring.

The invention has particular advantages in case the hydraulic fluid delivered by the main pump has a pressure which exceeds the pressure required for a certain work function in a given operating situation. Such an excessive pressure could be the result of the system having a pump operating at a constant pressure level, but it is more common when using one and the same pump for two or more work functions that different pressures are required for the work functions and the pump pressure then has to be adapted to the work function requiring the highest pressure. If, for example, hydraulic cylinders for lifting and steering are used simultaneously, the lift function may require a pressure of 200 bar and the steering may require 50 bar. With the system according to the invention, the control valve unit will not have to be used to reduce the pressure to the steering to approx. 50 bar with associated energy losses. Instead, the recovery unit can boost the pressure of the return flow from the steering with 150 bar in order to obtain the required pressure difference of 50 bar (200–150=50). This means that the pump pressure of 200 bar can be used both for the lift function and for the steering. Since the pressure drop instead occurs across the recovery unit, energy from the steering will be recovered and the recovered energy (with the exception of component-related losses) will be proportional to the product of the volume of hydraulic fluid passing the recovery unit multiplied by the pressure drop across the recovery unit.

As indicated above, the invention can advantageously be applied to a hydraulic system comprising a plurality of work functions and, according to one embodiment of the invention, the hydraulic system comprises a plurality of work functions with associated respective control valve unit (which control valve units, however, in their turn can be integrated into a common overall fluid control means for two or more work functions), and one said pilot-operated valve is provided for the respective work function. This gives a hydraulic system which creates conditions for recovering energy from any one of plurality of work functions in an efficient manner. It is possible to control which work function energy should be recovered from and to what extent energy should be recovered. This results in a very flexible system which enabled the total energy consumption of a working machine to be reduced considerably. The recovery unit is preferably arranged in parallel with all said pilot-operated valves, although it would also be possible to use a plurality of recovery units provided for different work functions. It shall be pointed out that the different variants of the hydraulic system described in connection with a work function of course also can be applied to two or more work functions.

By setting a pressure level for a first work function, with the pilot-operated valve, which enables a certain pressurization of the hydraulic machine, at the same time as the pilot-operated valves for the other work functions are set to a lower pressure level, hydraulic fluid from the first work function will be directed to the hydraulic machine, while hydraulic fluid from other work functions instead will be directed to tank via the respective pilot-operated valve.

Furthermore, conditions are created for enabling the part of the hydraulic system related to energy recovery to be designed as a separate unit, which can be connected to a given hydraulic system. Such a separate unit can be connected to the return side of one or several work functions in different types of hydraulic systems. Accordingly, an energy recovery system can be built as a separate unit and be offered as an option to a standard system. In the following text, the expression "energy recovery system" will be used for the part of the hydraulic system capable of constituting such a separate unit which can be connected to a base system in a simple manner.

The hydraulic system preferably comprises a pump, hereinafter also called a main pump or supply pump, for providing hydraulic fluid to said at least one work function. Such a pump can be adapted to supply one or several work functions with hydraulic fluid. According to one embodiment of the invention, the hydraulic system comprises a means for returning energy, recovered from a return flow from the work function, to the pressure side of the pump. This offers a possibility to recover energy which is then used to assist the main pump in supplying one or several work functions. This in its turn creates conditions for solving, or at least reducing, the problem of providing enough energy to drive the hydraulic system and the driveline at low engine speeds in a working machine. The main pump in a hydraulic system of the kind in question is namely usually mechanically connected to the engine of the working machine, such as a diesel motor, which is used to drive both the hydraulic system and the driveline for propelling the working machine. The speed of the main pump will thus become dependent on the speed of the diesel engine. The speed of the diesel engine, in its turn, depends on the desired propulsion speed of the working machine and the torque determined by the actual operation mode.

According to another embodiment of the invention, the recovery unit comprises a first hydraulic machine and a second hydraulic machine, and the first and second hydraulic machine are mechanically interconnected, and the first hydraulic machine is adapted to be driven by a flow of hydraulic fluid and the second hydraulic machine is adapted to pump hydraulic fluid by being driven by the first hydraulic machine. The first hydraulic machine is preferably connected to the return port to be driven by a return flow from the work function and the second hydraulic machine is adapted to pump hydraulic fluid from, for example, a tank to the pressure side of the main pump and/or to an accumulator and from the accumulator further to the pressure side (or suction side) of the pump. When using an accumulator, hydraulic fluid can be provided directly from the accumulator to the main g pump, or via the recovery unit, in that the accumulator supplies the first hydraulic machine and the second hydraulic machine pumps hydraulic fluid to the pressure side (or suction side) of the main pump.

Accordingly, with a suitable recovery unit, hydraulic fluid can be provided for supplying a work function in a way which is independent of the engine speed of the working machine. In many situations this flow, together with the flow generated independently by the main pump, provides a sufficient flow to the work functions, also if the diesel engine is operating at a low speed causing the capacity of the main pump to be reduced. Thus, in other words, the recovered energy stored or used instantaneously can be used for supporting the diesel engine.

In case a more simple recovery unit is used, for example in the form of a simple hydraulic machine, energy can also be recovered and returned to the pressure side of the main pump. If there is a sufficiently high pressure on the return flow, at least part of the flow could be returned directly to the pressure side of the main pump. Should the pressure be too low, the hydraulic machine could be used as a pump to increase the pressure so that the return flow can be returned and, in some cases, if the pressure of the return flow exceeds the pressure on the pressure side of the main pump by some margin, part of the energy could first be recovered in the hydraulic machine, and thereafter the return flow could be returned to the pressure side of the main pump.

According to another embodiment of the invention, the hydraulic system comprises a means for returning energy recovered from the work function to the suction side of the pump. There is of course a possibility to, at least to a certain extent, obtain the above-mentioned advantages with supporting the main pump also by instead providing hydraulic fluid to the suction side of the main pump. For instance, in case the hydraulic fluid pressure of the return flow is not sufficiently high to enable returning of hydraulic fluid to the pressure side, the energy can be utilized by returning it to the suction side of the main pump, since the main pump does not have to increase the pressure of this hydraulic fluid as much as if it instead had drawn hydraulic fluid from a tank. Thus, the variants described above with respect to return of energy (or in other words hydraulic fluid) to the pressure side of the main pump can also be applied with respect to return to the suction side of the main pump. In case of an excess of return flow, a certain amount can be directed to tank and/or be intermediately stored in an accumulator for successive return to the main pump.

According to a further embodiment of the invention, a pump, preferably the main pump for supplying the work functions, is drivable by a driveline of a working machine and adapted to brake the driveline during deceleration of the working machine, and the system further comprises a hydraulic control means for controlling a flow of hydraulic fluid, from the pressure side of the pump to the recovery unit, for recovering energy during deceleration of the working machine. Thereby, the recovery unit can also be used to decelerate the working machine, at the same time as deceleration energy is recovered during deceleration of the working machine.

According to a further embodiment of the invention, the recovery unit is adapted to dampen a relative movement caused by an external disturbance, at least in one direction, between a work implement and a machine body of the working machine, which work implement is moveable relative to the machine body by means of said work function. Preferably, the hydraulic system comprises a sensor for determining a reference position for the work implement relative to the machine body. Thereby, the recovery unit can recover energy at the same time as it is part of a suspension system for, for example, the lift arm of a wheel loader. With a suitable control of the recovery unit and the rest of the hydraulic system, a damped suspension system for a work implement can be achieved, at the same time as energy can be recovered with the recovery unit.

By means of the method according to the invention, energy can recovered with the recovery unit in a corresponding way as has been described above with respect to the hydraulic system. Since the maximum allowable pressure at the return port is controlled with a pressure limiting means through receiving signals, which preferably are electric, from a control unit, an upper limit for the amount of energy that is desired to be recovered from the work function can be selected.

The set maximum pressure also determines the smallest possible pressure drop across the control valve unit. A return flow of hydraulic oil from the work function will flow through the recovery unit and energy will be recovered as long as the recovery unit does not generate a higher back pressure than the set maximum allowable pressure. The invention creates conditions for controlling the energy recovery in a variable way depending on the actual operating mode. Within the range of the maximum allowable pressure, the pressure drop across the control valve unit will be determined by the resistance from the recovery unit. In many cases, the pressure drop across the control valve unit is preferably as small as possible in order to maximize the energy recovery, but sufficiently large to achieve the modulation of the requested return flow of hydraulic fluid. The recovery unit can, for example, be a hydraulic machine functioning as a hydraulic motor when recovering energy. The recovered energy can go directly to a consumer or be stored in a suitable manner.

The invention furthermore relates to a working machine provided with the hydraulic system according to the invention.

Further advantages and advantageous features of the invention are evident from the detailed description below and the following claims.

BRIEF DESCRIPTION OF DRAWINGS

With reference to the following drawings, a more detailed description of different exemplary embodiments of the invention will follow below.

In the drawings.

DETAILED DESCRIPTION

Figure 1:
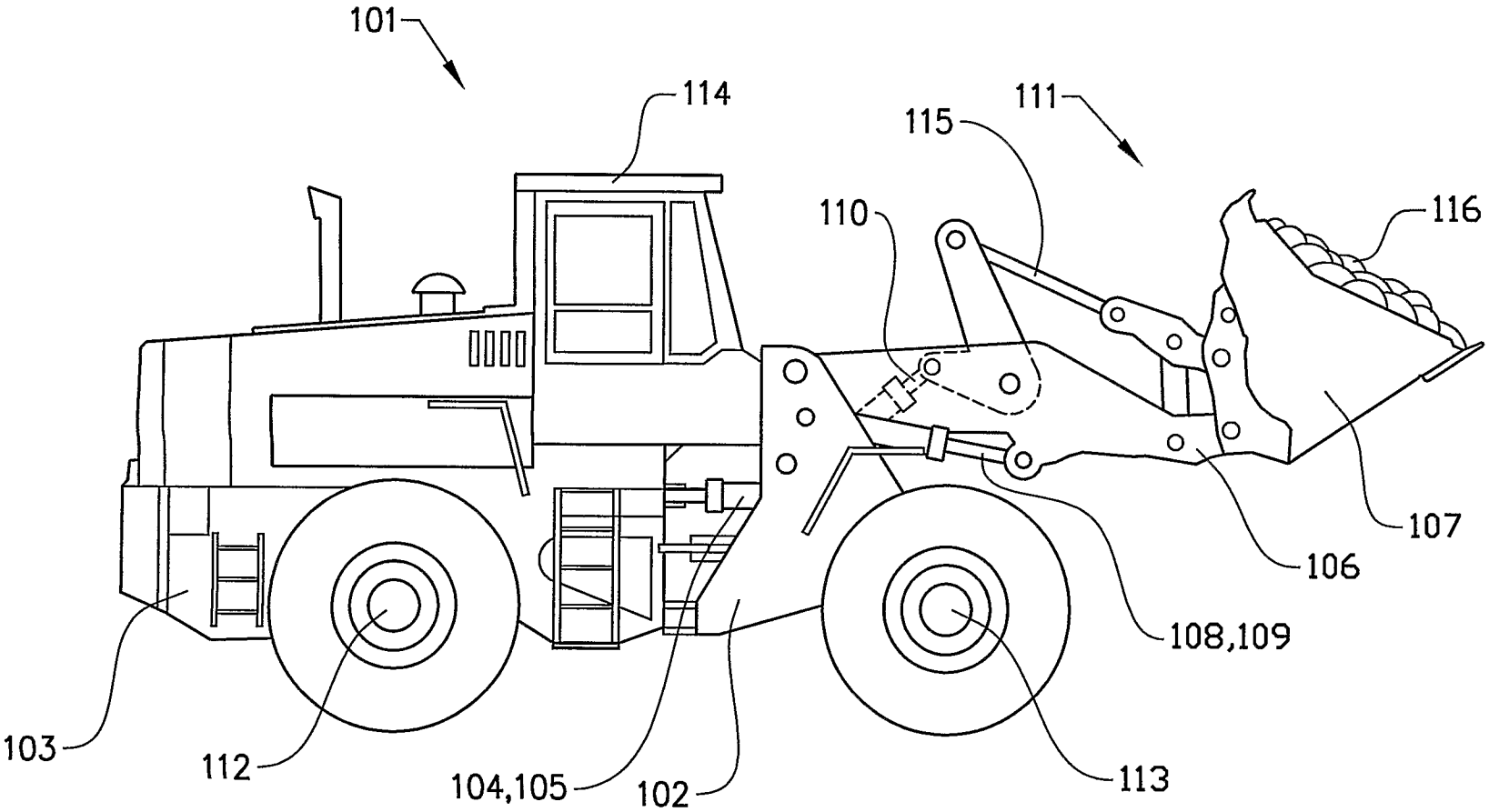
FIG. 1 is a side view of a wheel loader.

FIG. 1 shows a working machine in the form of a wheel loader 101. The wheel loader 101 should be seen as an example of a working machine to which the hydraulic system according to the invention can be applied. The wheel loader 101 comprises a front vehicle section 102 and a rear vehicle section 103. Each of these vehicle sections 102, 103 comprise a frame and wheels arranged on a drive axle 112, 113. The rear vehicle section 103 comprises an operator's cab 114. The vehicle sections 102, 103 are connected to each other in such a way that they can be pivoted relative to each other about a vertical axis by means of two hydraulic cylinders 104, 105, called steering cylinders, which are connected to the two vehicle sections 102, 103. Accordingly, the hydraulic cylinders 104, 105 are disposed on different sides of a centre line, extending in the longitudinal direction of the vehicle, for steering or turning the wheel loader 101 by means of the hydraulic cylinders. In other words, the wheel loader 101 is frame-steered.

The wheel loader 101 comprises a lift arm assembly 111 for handling objects or (loose) material. The lift arm assembly 111 comprises a lift-arm unit 106 and an implement 107 in the form of a bucket, which is mounted on the lift arm unit 106. Here, the bucket 107 is filled with material 116. A first end of the lift arm unit 106 is pivotally connected to the front vehicle section 102 in order to achieve a lifting movement of the bucket. The bucket 107 is pivotally connected to a second end of the lift arm unit 106 in order to achieve a tilting movement of the bucket. The lift arm unit 106 can be raised and lowered relative to the front section 102 of the vehicle by means of two hydraulic cylinders 108, 109. Each hydraulic cylinder 108, 109 is connected at a first end to the front vehicle section 102 and at the second end to the lift arm unit 106. The bucket 107 can be tilted relative to the lift arm unit 106 by means of an additional hydraulic cylinder 110, called a tilting cylinder, which is connected at a first end to the front vehicle section 102 and connected at the second end to the bucket 107 via a link arm system 115.

Figure 2:
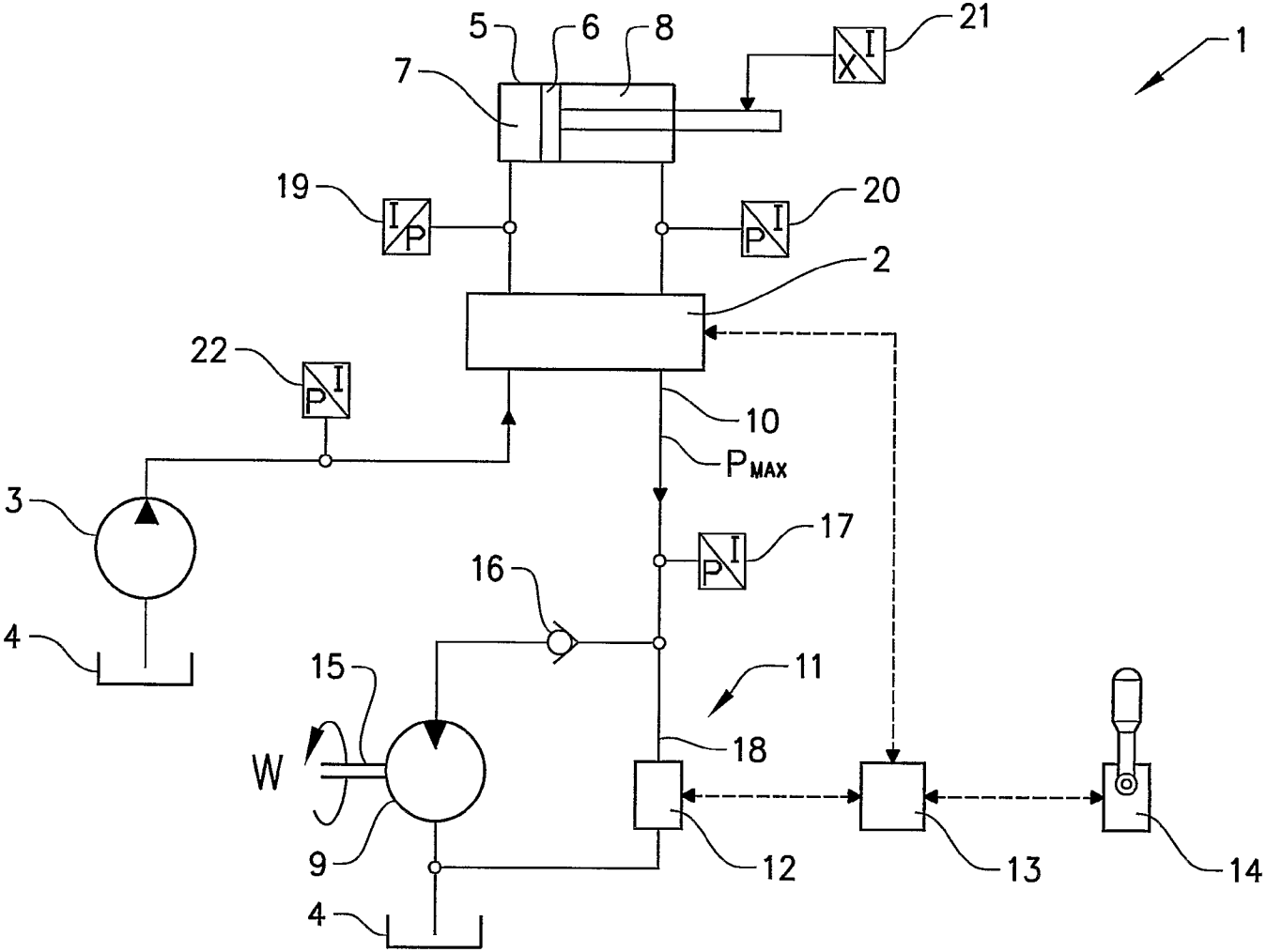
FIG. 2 is a hydraulic system according to the invention.

FIG. 2 is a schematic illustration of one embodiment of the invention. The hydraulic system comprises at least one work function 1 and a control valve unit 2 for controlling hydraulic fluid to and from the work function. A supply unit, such as a pump 3, is adapted to provide hydraulic fluid to the work function 1 via the control valve unit 2. The term hydraulic fluid used in the text is intended to include hydraulic oil as well as any other fluids which possibly may occur in a hydraulic system. The pump 3 can draw oil from a tank 4. (Although for reasons of simplicity different tank positions have been drawn in FIG. 2, suitably, in practice it is a matter of one and the same tank.) In this embodiment, the work function has a hydraulic cylinder 5 arranged on a working machine (not shown in FIG. 2) for moving a work implement. The hydraulic cylinder 5 is preferably provided with a double-acting piston 6, which can be pressurized on both sides 7, 8. The schematically illustrated control valve unit 2 can contain one or several valves of different types. It can preferably comprise two control valves adapted to control the work function. A first one of these control valves can be adapted to connect the pump 3 to the piston side 7 of the hydraulic cylinder, and a second one of these control valves can be adapted to connect the piston rod side 8 of the hydraulic cylinder to tank 4, for piston displacement in a first direction. The first control valve can further be adapted to connect the piston side 7 of the hydraulic cylinder to tank and the second control valve can then be adapted to connect the pump 3 to the piston rod side 8 of the hydraulic cylinder, for piston displacement in a second direction opposite to the first direction.

Furthermore, a recovery unit 9 is connected to a return port 10 of the control valve unit 2 for recovering energy from the work function 1. In the exemplary embodiment in FIG. 2, the recovery unit 9 is connected between the return port 10 and the tank 4. The hydraulic system also comprises a means 11 for limiting the pressure of the hydraulic fluid at the return port 10. The pressure limiting means 11 includes a pilot-operated valve 12 adapted to set a maximum allowable pressure at the return port 10 of the control valve unit 2, which pressure is variable by controlling the pilot-operated valve 12 by means of a control unit 13. The control unit 13 is further connected to the control valve unit 2 in order to control the magnitude of the flow of hydraulic fluid to and from the work function 1 by means of the control valve unit. This control, in its turn, is depending on the speed desired for the piston 6. An actuator 14 can be adapted to actuate the work function 1 and to request the desired speed of the work function 1.

In this embodiment, the recovery unit 9 is a hydraulic motor or a hydraulic machine, which can function both as a hydraulic motor and a pump. When recovering energy, a return flow from the work function 1 drives the hydraulic machine 9, which results in a work W done on a shaft 15 of the hydraulic machine 9. This energy can then be used or stored. For example, a generator can be connected to the hydraulic machine for converting the mechanical work into electrical energy. Preferably, the work function 1 is connected in such a way that a return flow from either the piston side or piston rod side of the hydraulic cylinder can be used for energy recovery. Since it is optional to recover energy from either the piston side 7 or the piston rod side 8 of the hydraulic cylinder 5, energy can be recovered both in the case when the piston is driven by an external load during so called regenerative recovery, and in the case when the piston is driven by the supply unit 3 at a pressure which exceeds the pressure required to displace the piston (and a load). In some cases, there is also a possibility to interconnect the piston and the piston rod side (by means of the control valve unit), so that both of these are in connection with the recovery unit 9 while energy is recovered.

Preferably, the pilot-operated valve 12 is connected to the return port 10 of the control valve unit 2 and connected in parallel with the recovery unit 9. Furthermore, the pilot-operated valve 12 is suitably electrically controllable by means of the control unit 13 and so designed that the maximum allowable pressure at the return port 10 of the control valve unit 2 is continuously variable. Accordingly, a desired maximum pressure can be set at the return port 10 of the control valve unit 2 during energy recovery. At a pressure, which exceeds the maximum allowable pressure, the pilot-operated valve 12 will open for a flow through the valve, which flow can be directed to tank 4. At a lower pressure of the return flow, the pilot-operated valve 12 will be closed, and the return flow will drive the hydraulic machine 9 as long as the resistance from the hydraulic machine 9 does not create a pressure which exceeds the maximum allowable pressure.

The pressure drop across the control valve unit 2 can be adjusted in a flexible manner, which is adapted to the actual operating situation, in that the pressure limiting means 11 comprises the pilot-operated valve 12. Thereby, the energy recovery thus can be adapted to the actual operating situation. By taking off a suitable amount of work done via the hydraulic machine 9, a pressure level, which is also adapted to the pressure prevailing in the hydraulic fluid upstream of the control valve unit 2, is obtained at the return port 10 of the control valve unit. The recovery unit is preferably connected to the control unit 13 to enable control of the recovery unit 9. For instance, the displacement of the hydraulic machine can be varied by means of the control unit 13. In other words, the pressure drop across the control valve unit 2 can be reduced for recovering energy via the recovery unit 9, at the same time as the required modulation of requested flow (and the desired speed of the piston 6) can be achieved. Assuming that all recovered energy can be used or stored, the pressure drop across the control valve unit 2 is suitably kept as small as possible in order to maximize the energy recovery, but sufficiently large to achieve the modulation of the requested return flow of hydraulic fluid.

The hydraulic system can further comprise a check valve 16, which is connected in series with the recovery unit 9 in a position between the return port 10 of the control valve unit and the recovery unit 9. In the illustrated embodiment, the check valve 16 is connected in series with the recovery unit 9 and connected in parallel with the pilot-operated valve 12 in order to block flow in a direction from the recovery unit 9 toward the work function 1 and to allow flow in a direction from the control valve unit 2 toward the recovery unit 9. When connecting a plurality of work functions to the recovery unit, suitably a check valve is used for the respective pilot-operated valve, so that it is ensured that hydraulic fluid from the work function from which energy is to be recovered is not drained to tank via the pilot-operated valve of another work function.

Furthermore, the hydraulic system can preferably comprise one or several pressure sensors 17, 19, 20, 22 for measuring the pressure of the hydraulic fluid upstream and downstream of the control valve unit on the supply and/or return side. These pressure sensors can also be integrated into the control valve unit. For example, when recovering energy during "parallel operation" (which has been described previously), a pressure sensor 20 can be used for measuring the pressure on the piston rod side of the hydraulic cylinder wherein the recovery unit is used to boost the pressure in order to ensure that the biasing pressure is the desired one.

A position sensor 21 can be used for indicating the position of a work implement. This will be described in greater detail below in an example where the recovery unit is used for obtaining a damped suspension of a work implement with the purpose of controlling the position of the work implement relative to the machine body of the working machine.

Figure 3:
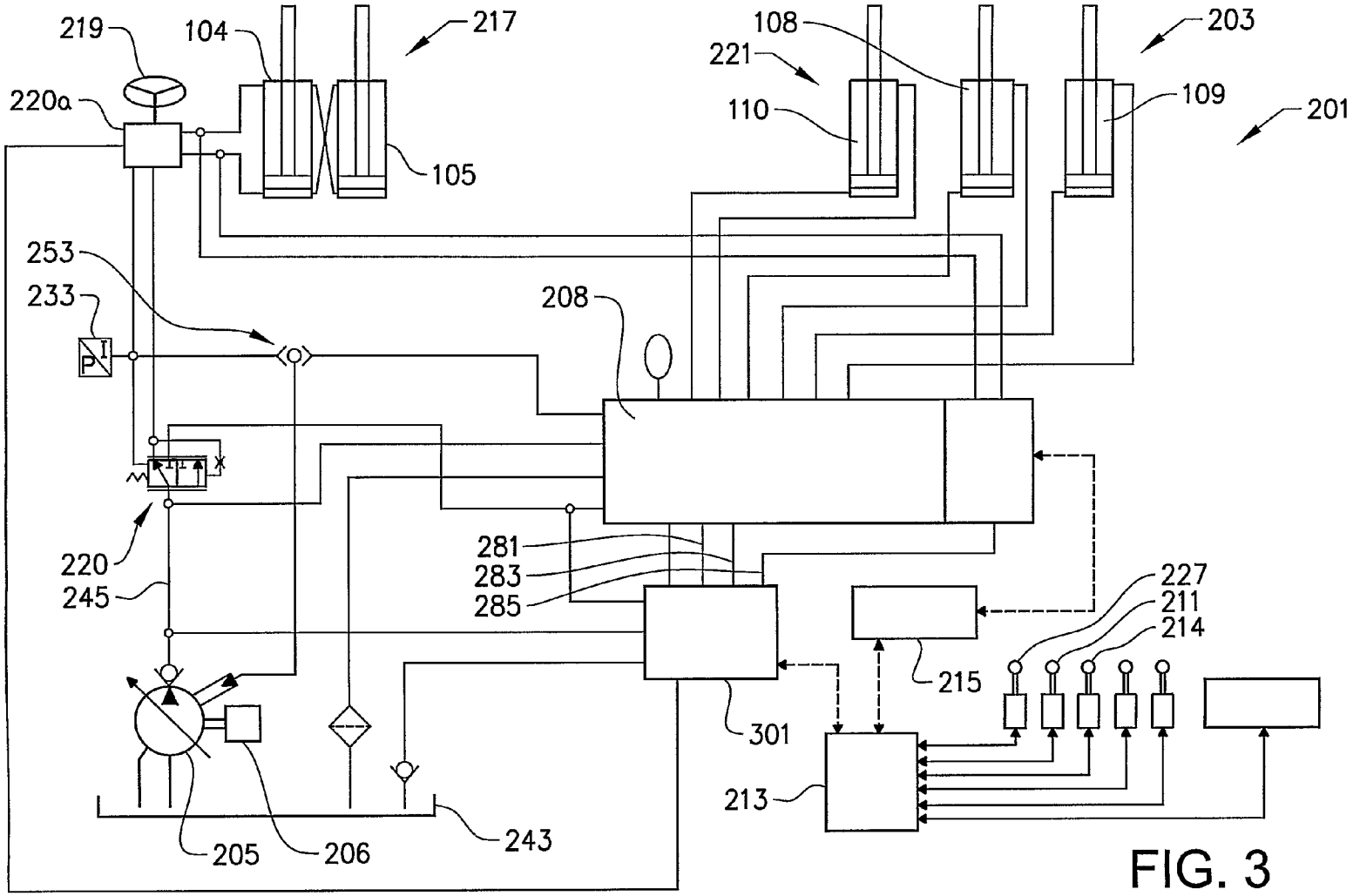
FIG. 3 is a hydraulic system according to the invention comprising a plurality of work functions for a wheel loader.

FIG. 3 shows a hydraulic system 201. The hydraulic system is designed to perform the hydraulic work functions of the wheel loader 101 (see also FIG. 1).

Figure 4:
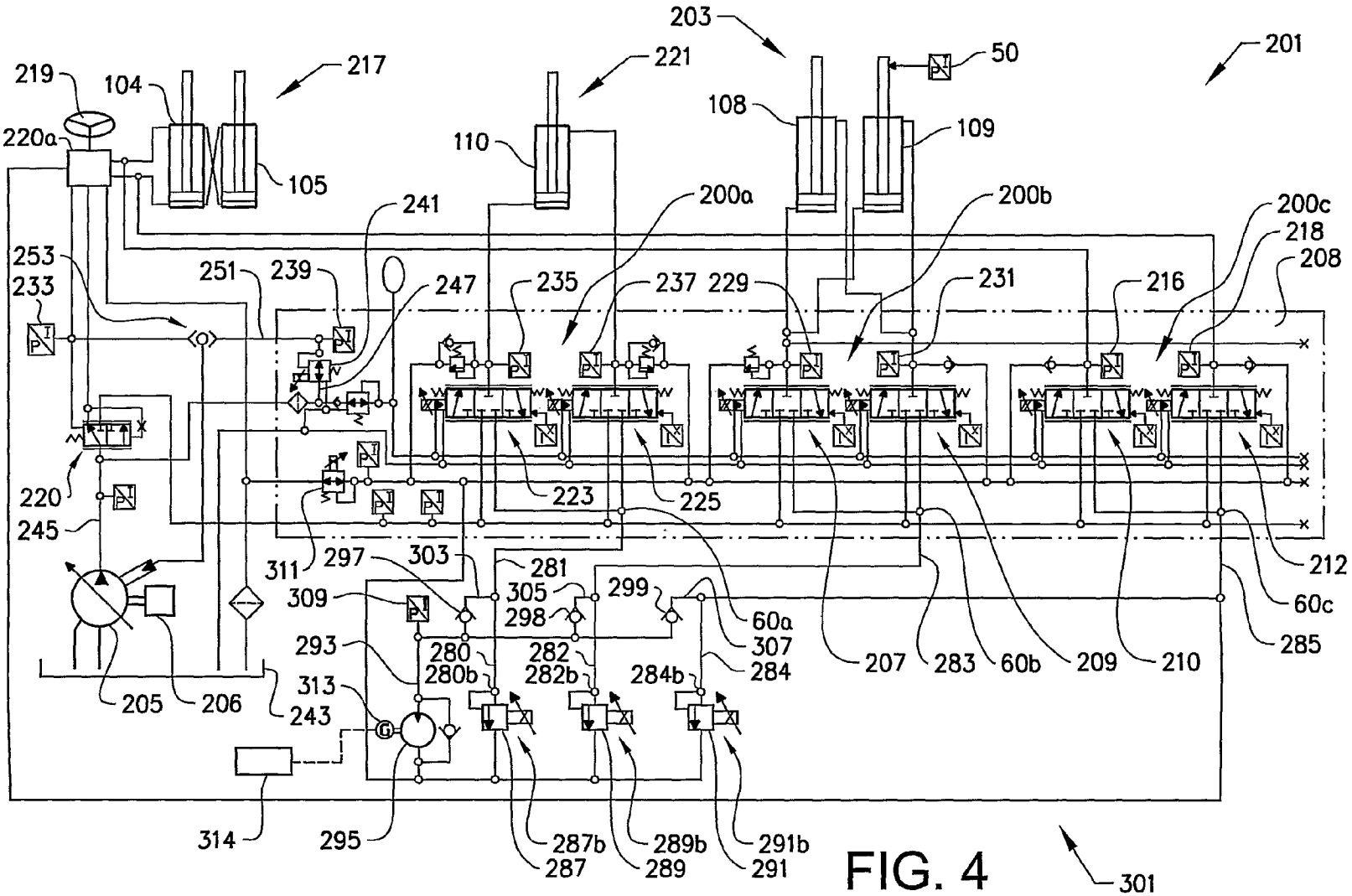
FIG. 4 shows the hydraulic system of FIG. 3 comprising a first example of an energy recovery system.

FIG. 4 shows the hydraulic system of FIG. 3 comprising a first example of an energy recovery system 301 shown in detail.

In the following text, reference is made to FIGS. 3 and 4. The hydraulic system 201 is provided with a first work function 203 for lifting and lowering the lift arm unit of the wheel loader. The work function comprises said two hydraulic cylinders 108, 109 for operating the lift arm unit 106.

The system 201 further comprises a pump 205 adapted to supply said work function 203 with pressurized hydraulic fluid via a hydraulic circuit. The pump 205 is driven by the propulsion engine 206 of the vehicle, which can be e.g. a diesel engine. Suitably, the pump 205 has a variable, preferably infinitely variable, displacement to provide the flow required for the work functions. The system 201 comprises a fluid control means 208 having a control valve unit for the respective work function. The respective control valve unit, in its turn, can comprise a hydraulic circuit having one or several control valves adapted to control the delivery of pressurized hydraulic fluid from the pump 205 to the respective work function and from the respective work function to a tank 243.

In the illustrated embodiment, as is evident from FIG. 4, the control valve unit 200*b* comprises two control valves 207, 209, in the form of flow valves, for the lifting and lowering movement. These control valves are arranged between the pump 205 and the lifting cylinders 108, 109 in the circuit, for controlling the lifting and lowering movement. When displacing the pistons in a first direction, the first 207 of these valves is adapted to connect the pump 205 to the piston side of the hydraulic cylinders 108, 109, and a second 209 one of these valves is adapted to connect the tank 243 to the piston rod side of the hydraulic cylinders. When displacing the pistons in a second, opposite direction, the first valve 207 is adapted to connect the tank 243 to the piston side, and the second valve 209 is then adapted to connect the pump 205 to the piston rod side. This offers great possibilities of varying the control. In particular, in certain cases, there is no need to connect the pump 205 and the tank 243 simultaneously to the work function. For instance, the pump 205 does not have to be connected during load lowering.

As is evident from FIG. 3, the hydraulic system further comprises a control unit 213 which contains software for controlling the work functions. The control unit is also called a CPU (Central Processing Unit) or ECM (Electronic Control Module). Suitably, the control unit 213 comprises a microprocessor.

An operator-controlled element 211, in the form of a lift lever, is operatively connected to the control unit 213. The control unit 213 is adapted to receive controls signals from the lift lever and to control the control valves 207, 209 of the control valve unit 200*b* according to the lever position. This can occur directly from the control unit 213 or, as illustrated in FIG. 3, via a valve control unit 215. The control unit 213 preferably controls more general control strategies for the working machine and the control unit 215 controls basic functions of the control valve units 200*a*, 200*b* 200*c* of the fluid control means 208. The control units 213, 215 can of course also be integrated into a single unit. When driving the pump 205, a flow of hydraulic fluid out to the hydraulic cylinders 108, 109 is obtained. The magnitude of the flow reaching the hydraulic cylinders can be adjusted by the control valves 207, 209.

The hydraulic system 201 further comprises a second work function 217 for steering the working machine. The work function comprises two hydraulic cylinders, hereinabove called the steering cylinders 104, 105 (see also FIG. 1). An operator-controlled element 219, in the form of a steering wheel, is hydraulically connected to the steering cylinders 104, 105 via a valve unit in the form of an orbitrol unit 220*a*, for direct-control of the steering cylinders 104, 105.

As is evident from FIG. 4, the control valve unit 200*c* for the steering function comprises two control valves 210, 211, in the form of flow valves, arranged between the pump 205 and the steering cylinders 104, 105 in the circuit for steering the working machine. The steering cylinders can also be operated by means of an operator-controlled element 214 (shown in FIG. 3), in the form of a steering lever, which is operatively connected to the control unit 213. The control unit 213 is adapted to receive control signals from the steering lever 214 and to control the control valves 210, 212 according to the lever position.

The system 201 further comprises a third work function 221, for tilting the work implement, arranged on the lift arm unit. The work function comprises a hydraulic cylinder, hereinabove called the tilting cylinder 110. In a similar way as for the lift function, the control valve unit 200*a* for the tilt function comprises two control valves 223, 223 arranged between the pump 205 and the tilting cylinder 110 for controlling the forward and return movement of the implement relative to the lift arm unit. An operator-controlled element 227, in the form of a tilt lever, is operatively connected to the control unit 213. The control unit 213 is adapted to receive control signals from the tilt lever and to control the control valves 223, 225 according to the lever position.

A prioritizing valve 220 is arranged on the output conduit 245 of the pump for automatically prioritizing the steering function over the lift function and the tilt function, with the purpose of ensuring that the steering always gets the required pressure and flow. The prioritizing valve 220 regulates on pressure and ensures that the steering receives the required pressure. When at correct pressure, also the required flow to the steering is obtained, which occurs at the expense of the other work functions if the total hydraulic fluid requirement would exceed what the system is capable of providing.

In the illustrated embodiment, the hydraulic system 201 is a load sensing system and; for this purpose, suitably comprises a plurality of pressure sensors 229, 231; 216, 218; 235, 237; 233, 239. By means of pressure sensors, the actual pressure of each of said work functions can be sensed. The lift function of the system preferably comprises two pressure sensors 229, 231, out of which one 229 is adapted to measure the pressure on the piston side of the lifting cylinders (and is suitably arranged on a conduit to the piston side of the lifting cylinders) and the second one 231 is adapted to measure the pressure on the piston rod side of the lifting cylinders (and is suitably arranged on a conduit to the piston rod side of the lifting cylinders). In a corresponding way, the tilt function of the system comprises two pressure sensors 235, 237, out of which one 235 is adapted to measure the pressure on the piston side of the tilting cylinder (and is suitably arranged on a conduit to the piston side of the tilting cylinder) and the second one 237 is adapted to measure the pressure on the piston rod side of the tilting cylinder (and is suitably arranged on a conduit to the piston rod side of the tilting cylinder).

The steering wheel control function comprises a pressure sensor 233 in a conduit connected to the steering cylinders 104, 105. The pressure sensor 233 is preferably placed on the L S conduit, which receives the same pressure as one cylinder side when steering in one direction and as the other cylinder side when steering in the other direction. In neutral, the L S conduit is connected to tank.

In a corresponding way, the lever control function of the system comprises two pressure sensors 216, 218 out of which one 216 is adapted to measure the pressure on the piston rod side of a steering cylinder (and is suitably arranged on a conduit to the piston rod side of the steering cylinder) and the second one 218 is adapted to measure the pressure on the piston side of the steering cylinder (and is suitably arranged on a conduit to the piston side of the steering cylinder).

The hydraulic system can further comprise an electrically controlled valve 241 adapted to control the pressure on the pressure side of the pump via a hydraulic signal. The system 201 can also comprise an additional pressure sensor 239 for sensing a pressure which is indicative of the pressure on the pressure side of the pump. The pressure sensor 239 is preferably adapted to sense the pressure in a position downstream of the electrically controlled valve 241. When a work function is actuated, the control unit registers the pressure in the hydraulic cylinder in question. The control unit then adjusts the valve 241 to obtain the desired pressure in the L S conduit (which in its turn controls the pressure of the pump). The pressure sensor 239 is adapted to sense the pressure and the control unit 213 is adapted to receive a signal from the pump pressure sensor 239 with information about the pressure level. The pressure sensor 239 will sense the pump pressure directly, when the valve 241 is fully open, but in normal operation modes the pressure sensor 239 senses the modulated pressure from the valve 241. This function implies that the hydraulic system can be operated with a variable control pressure.

Accordingly, the control unit 213 is operatively connected to the pressure sensors 216, 218, 229, 231, 233, 235, 237, 239 and the electrically controlled valve 241. Thus, the control unit 213 receives electrical signals from the pressure sensors and generates an electrical signal for controlling the electrical valve 241, which in its turn emits a hydraulic signal to the main pump 205. The control unit 213 is adapted to generate a control signal to the electrically controlled valve 241 corresponding to the highest sensed load pressure for any one of the work functions, so that the pressure on the pressure side of the pump becomes slightly higher than the required load pressure.

As said before, the control unit 213 is adapted to receive signals from the control levers 211, 214, 227. When the operator wants to lift the bucket, the lift lever 211 is operated. The control unit receives a corresponding signal from the lift lever 211 and controls the control valves 207, 209 to such a position that the pump is connected to the piston side of the lifting cylinders 108, 109 and the piston rod side of the lifting cylinders is connected to the tank 243. The control unit further receives signals from the pressure sensor 229 on the piston side of the lifting cylinders and from the pressure sensor 239 downstream of the pump. Based on the received signals, a desired pump pressure at a level above the sensed load pressure is determined, and the electrically controlled pump control valve 241 is controlled accordingly.

The control unit 213 is preferably adapted to coordinate the opening degree of the control valves 207, 209 and the output pressure of the pump 205 for optimum operation.

A hydraulic means 253, in the form of a reversing valve, is arranged on the conduit 251 between the electrically controlled pump control valve 241 and the pump 205. The reversing valve 253 is adapted to receive hydraulic signals from the second work function 217 (for the steering) and the pump control valve 241. The reversing valve is further adapted to control the pump 205 according to the received signal indicating the highest pressure. Accordingly, the hydraulic means (reversing valve) 253 selects the higher pressure in an output signal made up of two input pressure signals.

The respective control valve unit of the control means 208 is preferably adapted for double-acting hydraulic cylinders where the control valves are electrically controlled and have separated inlets and outlets and pressure sensors on both sides of the control valves and position sensors on the slides.

FIG. 4 shows one said recovery unit 295 and a pressure limiting means 287*b*, 289*b*, 291*b* for the respective work function. Each pressure limiting means comprises one said pilot-operated valve 287, 289, 291. The recovery unit 295, suitably a hydraulic machine, is connected to a generator (or to an electric machine which can function both as a generator and a motor) in order to, together with the pilot-operated valves, produce a recovery system 301 for electrical energy. The respective pilot-operated valve 287, 289, 291 is connected to the return port 60*a*, 60*b*, 60*c* of the respective control valve unit.

The energy recovery system 301 comprises a plurality of first conduits 280, 282, 284 on which the pilot-operated valves 287, 289, 291 are arranged. The respective said first conduit comprises a pilot-operated valve and is connected between a return conduit 281, 283, 285 from one of said work functions and the tank 243 in the hydraulic system.

The energy recovery system 301 further comprises a second conduit 293, which is connected to each of the first conduits 280, 282, 284 upstream of the pilot-operated valves 287, 289, 291. The recovery unit 295 is arranged on the second conduit 293 for the purpose of being driven by a flow of hydraulic fluid from one or several of said work functions for recovering energy.

The energy recovery system 301 comprises a plurality of branch conduits 303, 305, 307 on which check valves 297, 298, 299 are arranged. The respective branch conduit 303, 305, 307 is arranged between the respective first conduit 280, 282, 284 and the second conduit 293 in order to block flow in a direction from the recovery unit 295 toward the respective work function by means of the check valves.

The energy recovery system 301 further comprises a pressure sensor 309 in the second conduit 293 upstream of the recovery unit 295.

The first conduits 280, 282, 284 are further connected to the second conduit 293 downstream of the pilot-operated valves 287, 289, 291 and the recovery unit 295. In other words, the respective pilot-operated valve 287, 289, 291 is connected in parallel with the recovery unit.

The electronic control unit 213 (shown in FIG. 3) is adapted to control each of the pilot-operated valves 287, 289, 291 (shown in FIG. 4) individually to achieve energy recovery from one of the work functions. The control unit 213 is further adapted to receive a signal with information about the pressure, sensed by the pressure sensor 309, resulting from the resistance from the recovery unit 295 (within the range of the maximum allowable pressure set by the pilot-operated valve in question).

Accordingly, the return flows of the work functions pass via the energy recovery system 301. Naturally, more or fewer work functions can be connected to the energy recovery system. Although in many cases it is advantageous that both piston side and piston rod side of the hydraulic cylinder are connectable to the energy recovery unit by means of the control valve unit, there is of course a possibility to choose to have only one cylinder side connectable for one or several work functions. The return flow from the other cylinder side then suitably has its outlet in tank.

A description of different variants of the hydraulic system according to the invention and different ways of utilizing it for energy recovery will follow below.

According to a first variant, energy is recovered when lowering the lift arm assembly 111. (See also FIG. 1.) The control unit registers that the operator wants to lower the assembly through receiving a signal from the lift lever. The control unit sets the pilot-operated valve 289, which is associated with the lifting cylinders 108, 109, to a pressure which is slightly higher than the pressure of the return flow which is desired, and opens the control valve 207 to allow a return flow from the return port. The desired pressure of the return flow is obtained by adjusting the resistance of the hydraulic motor 295. Hydraulic fluid can now flow from the piston side of the lifting cylinders 108, 109 through the control valve 207, via the check valve 298, and through the hydraulic motor 295 and further to the tank 243 via a counterpressure valve 311. (Hydraulic fluid will only pass the pilot-operated valve 298 to the extent that temporary pressure peaks arise and/or flow peaks arise which the hydraulic motor cannot handle.) The piston rod side of the lifting cylinders 108, 109 is filled via anticavitation valves in a conventional manner. Thereby, the generator 313, which is driven by the hydraulic motor 295, can deliver the recovered energy in the form of electrical energy to, for example, an energy storing means 314, such as a battery or a capacitor.

Different control options can be used for energy recovery when lowering the lift arm assembly;

No Recovery:

All flow passes through the pilot-operated valve 289, which is set to generate a minimum back pressure. The control of the magnitude of the return flow occurs by means of the control valve 207 in accordance with the desired lowering speed of the lift arm assembly.

Full Recovery:

The pilot-operated valve 289 is controlled so that a maximum allowable pressure is obtained, which means that the entire return flow passes through the hydraulic motor 295. The magnitude of the return flow can now be controlled via the speed of the generator 313 in order to obtain the desired lowering speed of the lift arm assembly, or the flow control occurs by means of the control valve 207.

Partial Recovery:

The control unit can determine whether, in a particular operation mode, only part of the potentially recoverable energy can be recovered and how much energy/power can be recovered. The pilot-operated valve 289 is controlled so that a maximum allowable pressure is obtained at the return port, which pressure is adapted to the energy recovery level desired, (with the exception of losses in the recovery system, the recovered energy per unit of time is equal to the actual pressure drop across the hydraulic motor 295 multiplied by the flow through the hydraulic motor.) The flow through the hydraulic motor is determined by the speed of the generator 313. In this operation mode, hydraulic fluid flows in parallel via both the hydraulic motor 295 and the pilot-operated valve 289. There are different ways of controlling the speed of the hydraulic motor 295. For instance, the load (torque) from a generator connected to the hydraulic motor can be adjusted so that a desired speed is obtained. Alternatively, the load is kept constant and the speed is controlled via the pilot-operated valve 289. The total flow (which determines how fast the piston side of the hydraulic cylinder is emptied and thereby the lowering speed of the lift arm assembly) is controlled by means of the control valve 207.

Combined Recovery:

It is possible to switch between the above control options (No, Full and Partial recovery) during one and the same lowering operation.

Force reduction: If a sufficient lowering speed cannot be reached, even if the control valve 207 is almost fully open and the pilot-operated valve 289 is set to generate a low back pressure (alternatively that the generator puts a relatively low load on the hydraulic motor which results in a low back pressure), also the control valve 209 connecting the supply pump to the piston rod side is opened. Thereby, the piston of the hydraulic cylinder is pressed down by means of pressurization on the piston rod side. The force of the hydraulic cylinder in a direction toward the load is reduced, since also the piston rod side is pressurized. The control unit can determine when the supply pump is to be actuated. This can, for example, be done according to the following:

- The pump is actuated when the return flow is below a specific level or, alternatively, when the flow (by some margin) is below the flow requested via the lift lever. The actual flow across the control valve 207 can be calculated on the basis of slide position and pressure drop across the control valve 207 or, alternatively, by means of time measurement and with information from a position sensor 50 indicating the position of the piston of the hydraulic cylinder.
- Alternatively, the actuation of the pump can take place when the pressure on the piston side of the hydraulic cylinder is below a certain specific level. This level can be fixed or be a level dependent on the requested lowering speed.
- It is also possible to control the actuation of the pump on the basis of a combination of the above conditions with respect to return flow and pressure on the piston side of the hydraulic cylinder.

According to an alternative embodiment of the invention, both control valves 207, 209 can be controlled so that their outlets to the energy recovery system are opened, which means that both the piston side and the piston rod side are connected to the recovery unit. This, in its turn, will result in a reduced return flow to the recovery system (but a higher pressure), since the lowering operation will be carried out primarily by hydraulic fluid flowing from the piston side to the piston rod side. This can be used, for example, when the bucket is empty and a rapid lowering is to take place without risking overspeeding the hydraulic motor 295.

When emptying the bucket (tilt-out), energy can be recovered in substantially the same manner as has already been described for the lift function. The work function for tilting the bucket is illustrated with the hydraulic cylinder 110 and the associated control valves 223, 225 in FIG. 4.

According to a further variant, energy is recovered when steering the working machine with the steering lever. The steering function is somewhat special due to the fact that the load is moving substantially horizontally or, in other words, perpendicularly to the gravitational direction. Friction and inertia of the components of the working machine result in that the load sometimes has to be moved by means of the supply pump 205, and sometimes instead it has to be decelerated with the control valves 210, 212. In order not to get a "nervous" and jerky steering, at the same time as the pump pressurizes the steering cylinders for the desired movement, the return side has to be boosted with a certain back pressure, which is capable of decelerating the load when the load tends to continue its movement without the influence of the pump on the steering cylinders. In the present systems, a biasing pressure on the return side, the magnitude of which varies depending on the flow, is used. This back up pressure is usually within the range 10-40 bar. By using the energy recovery system to achieve the biasing pressure, energy can be recovered according to the following:

No recovery:

All flow passes through the pilot-operated valve 291, which is set to generate a minimum back pressure. The required biasing pressure is controlled by means of the one of the control valves 210, 212 which controls the return flow to the pilot-operated valve 291.

Full Recovery:

The pilot-operated valve 291 is controlled so that a suitable maximum allowable pressure is obtained, which means that the entire flow passes through the hydraulic motor 295. The biasing pressure can now be controlled by adapting the load from the generator 313 on the hydraulic motor 295.

Partial Recovery:

The control unit can determine whether, in a particular operation mode, only part of the potentially recoverable energy can be recovered and how much energy/power can be recovered. The pilot-operated valve 291 is controlled so that a maximum allowable pressure is obtained at the return port, which pressure is adapted to the desired biasing pressure. The biasing pressure can now be controlled (up to the maximum allowable pressure) by adapting the load from the generator 313 on the hydraulic motor 295. In this operation mode, hydraulic fluid flows in parallel via both the hydraulic motor 295 and the pilot-operated valve 291. There are different ways of controlling the speed of the hydraulic motor 295. For instance, the load (torque) from a generator connected to the hydraulic motor can be adjusted so that the desired speed is obtained. Alternatively, the load is kept constant and the speed is controlled via the pilot-operated valve 289.

Combined Recovery:

It is possible to switch between the above control options (No, Full and Partial recovery) during one and the same steering event.

The level of the biasing pressure can be determined on the basis of one of the following criteria (or on the basis of a combination of them):

Utilization of a fixed predetermined biasing pressure.

Utilization of a variable biasing pressure being a function of:

Steering rate and/or

Machine speed and/or

Actual steering angle

Utilization of a demand-related biasing pressure:

The biasing pressure is increased when there is an increased tendency to jerkiness in the steering, and is reduced according to a given time ramp or another type of filtration when there is less jerkiness. A jerky steering can be detected via the derivative of the steering rate which can be registered via the generator 313 or, alternatively, via position sensors on the steering cylinder (steering cylinders) 104, 105 or, alternatively, via a calculation of the flow across the outlet valves 210 or 212. Another way is that the control unit, via the pressure sensors 216, 218, registers that large pressure fluctuations arise in the steering cylinders.

According to another variant, energy is recovered when steering with the steering wheel 219 (via the orbitrol unit). This is accomplished according to the description above of the lever steering, with the exception of the following:

No Recovery:

The pilot-operated valve 291 is controlled so that the maximum allowable pressure corresponds to the desired biasing pressure. The load on the hydraulic motor from the generator 313 is adjusted to such a high level that the hydraulic fluid does not pass through the hydraulic motor 295, but substantially the entire flow passes through the pilot-operated valve 291. Alternatively, a shut-off valve can be added before or after the hydraulic motor 295 in order to prevent that a flow occurs through the hydraulic motor 295.

Figure 5:
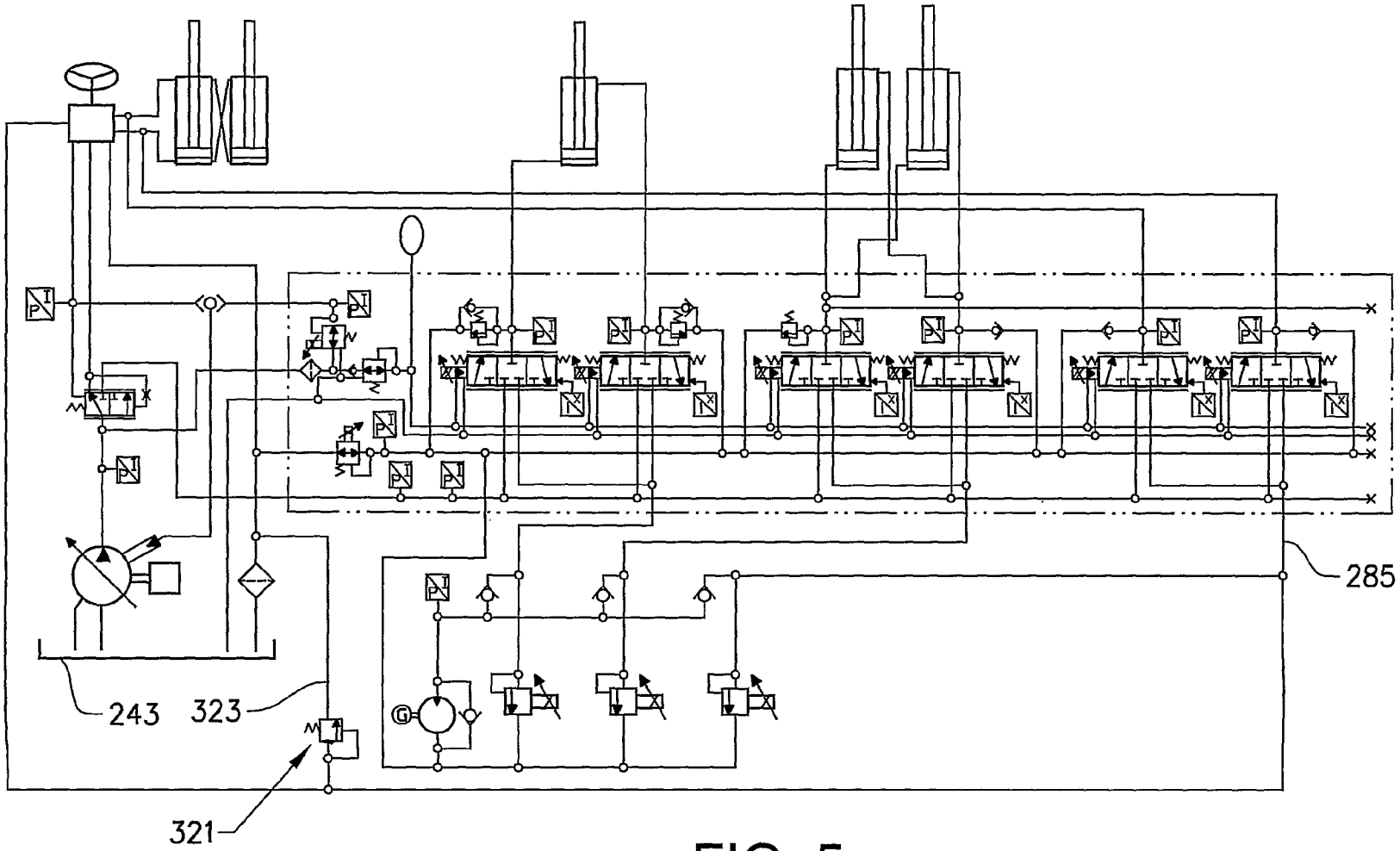
FIGS. 5-9 show different variants of the first example of the energy recovery system.

FIG. 5 shows a further development of the embodiment in FIG. 4. A pressure limiter 321, such as a hydraulic pressure limiting valve, is arranged on a conduit 323 connecting the return conduit 285 from the lever control function and the tank 243. Thereby, the reliability is increased further since it can be ensured that the steering function will be supplied also in case of an electrical malfunction causing a stop in the return flow. If a malfunction should occur in the recovery system, the return flow of hydraulic fluid can still always reach the tank 243 via the pressure limiting valve 321. Thereby, the opening pressure of the pressure limiting valve is suitably set slightly above the pressure level desired for use in the energy recovery system. This pressure limiting valve 321 could also, alternatively, be used with regard to the steering wheel steering. If, for some reason, such a high biasing pressure that the orbitrol unit could not handle the biasing pressure in question should be used for the lever steering, a check valve can be added in order to prevent that the biasing pressure for the lever steering reaches the pressure limiter and the orbitrol unit.

According to a further variant, energy is recovered when several work functions are used simultaneously. If, for example, lifting and steering are used simultaneously and the lift function requires the pump pressure 200 bar and the steering 50 bar, the energy recovery system can boost the return pressure to the steering with 150 bar. This means that the 200 bar pump pressure can be used both for lifting and for steering. The biased energy from the steering is recovered.

With reference to FIG. 4, another example, where the energy recovery system is used as an active suspension system for a work implement of the working machine, is described below. The hydraulic system preferably comprises a sensor 50 for determining a reference position for the work implement which is mounted on the working machine. The work implement is movable relative to the machine body of the working machine by means of one said hydraulic work function. The work implement can, for example, be the lifting assembly or other types of functions where the undesired kinetic energy of the machine body and/or the work implement is recovered at the same time as the relative movement is damped. The recovery unit is adapted to dampen a relative movement, at least in one direction, between the work implement and the machine body. This is of importance when influenced by an external disturbance, which may occur, for example, when moving the working machine. In the following, the suspension system of the lift function, where damping of a lowering movement of the bucket relative to the machine body can take place while energy is recovered, will be described: (A suspension system for the tilt function can function in a similar manner.) Via the position sensor 50 (see FIG. 4), which position sensor can be fitted on a lifting cylinder, the control unit registers the position of the lifting assembly relative to the machine body. The computer of the control unit stores into memory the position the lifting assembly had immediately before the suspension function was actuated and the actual pressure level on the piston and/or piston rod side of the hydraulic cylinder. The lift arm assembly is usually pivotally connected to the machine body of the working machine. This means that if the working machine drives on a bumpy surface, i.e. drives over a small elevation (a bump) and/or into a small hole, this is reflected in the hydraulic cylinders in the form of changes in pressure on the piston and piston rod sides.

Via the recovery system, the control valve 209 opens the piston rod sides to the tank 243. When the pressure on the piston side becomes lower than the initial pressure, the control valve 207 to the pump 205 is opened so that oil can be replenished and lifts the lift arm assembly a bit. If the pressure on the piston side becomes higher, the control valve 209 closes and the control valve 207 opens to the recovery system so that the assembly is lowered, wherein the flow of hydraulic fluid generates electrical energy in the recovery system. When lowering the lift arm assembly, deceleration can occur via the following:

The generator 313 has a torque control, i.e. the load from the generator on the hydraulic motor can be increased until the lifting assembly stops because the back pressure from the hydraulic motor is sufficiently large. The piston stroke length and piston speed of the hydraulic cylinder will depend on the selected torque control strategy. The pilot-operated valve 289 is controlled to set a maximum allowable pressure which allows the desired pressure level for the recovery unit. • The generator 313 has a speed control, wherein the piston stroke length and piston speed of the hydraulic cylinder will depend on the selected speed control strategy. The pilot-operated valve 289 is controlled to set a maximum allowable pressure which allows the desired pressure level for the recovery unit.

If the energy recovery is insufficient to achieve the desired deceleration of the lifting assembly, which can be due to the fact that the energy recovery is fixed at a given level or limited for another reason, an additional deceleration can occur via the control valve 207 (with associated losses) and bypassing of hydraulic fluid can occur via the pilot-operated valve 289.

The control can be performed such that the assembly stays around the initial position, which can registered by the position sensor 50. The maximum allowable amplitude relative to the initial position should be limited. This is for safety reasons, and so that the assembly does not fold up too much when pulling force is applied to the bucket.

Furthermore, the system creates conditions for a variable "springing/damping" characteristic. Preferably, the system essentially works like a spring with damping, i.e. if a disturbance pushes the lifting assembly down, electrical power is obtained by driving the generator, and at the same time the movement is decelerated (like a spring) by means of the above control strategies. In a corresponding way, when lifting of the lifting assembly takes place by means of the supply pump, a certain power level will be added, which then abates so that the lifting assembly stops. The form of this spring characteristic can be a function of the following, or parts thereof:

The Magnitude of the Disturbance Force:

The spring characteristic can be a function of the magnitude of the disturbance force. The difference in pressure of the hydraulic cylinder before and after the disturbance is a measure of the disturbance force.

The Magnitude of the Load Weight:

The spring characteristic can be a function of the load weight. The pressure on the piston side of the hydraulic cylinder is a measure of the load weight.

Type of Handling:

The spring characteristic can be varied depending on which handling and/or work implement (bucket, pallet fork, timber grab etc.) which is to be utilized. The control unit can register the actual handling and select from a number of predetermined characteristics adapted for different work operations.

Transport and Work Mode:

Different characteristics can be selected depending on whether the machine is only operated in transport mode or if work with the lifting assembly is in progress. This can, for example, be indicated by registration of the speed of the working machine and/or registration of any lever movements.

According to a further variant, the energy recovery system is used to add a pump function to the hydraulic system. See FIG. 6. The hydraulic system comprises a means 520 for returning energy, recovered from a return flow from the work function, to the pressure side of the pump. An electric machine 513 is mechanically connected to the hydraulic machine 595. The electric machine can be driven by the hydraulic machine and thus be used as a generator when recovering energy, but it can also be used as a motor to drive the hydraulic machine as a pump. Accordingly, the hydraulic machine 595 can function both as a hydraulic motor and a pump.

An electrically controlled valve 515 is arranged on a tank conduit 517 connecting the hydraulic machine 595 to the tank 243. The valve can be used to in order to be able to prevent flow of hydraulic fluid from the hydraulic machine to the tank 243. A pump conduit 521 is adapted to connect the hydraulic machine to the outlet side (pressure side) of the main pump 205. This pump conduit 521 is suitably connected at one of its ends to the tank conduit 517 in a position between the hydraulic machine 595 and the valve 517, and connected at its other end to the outlet side of the main pump 205. A check valve 519 can be arranged on the pump conduit 521. Thereby, hydraulic fluid is prevented from reaching the energy recovery system directly in a direction from the main pump 205. A check valve 523 can also be arranged on the outlet side of the main pump so that hydraulic fluid from the energy recovery system cannot pass to the tank 243 via the main pump 205.

In this way, the recovery unit can also provide hydraulic fluid to the work functions of the hydraulic system. The recovery unit uses hydraulic fluid arriving from the return line of a work function.

In a further variant of this system, shown in FIG. **6*b*, the check valve 523 at the main pump 205*b* has been eliminated. The main pump 205*b*** is adapted to function both as a pump and a hydraulic motor. The pump is adapted to provide a torque when hydraulic fluid flows from the recovery unit

595*b* to the pressure side 50*b* of the pump and further through the pump to the suction side 51*b* of the pump, at the same time as the pump provides the required pressure on the pressure side for supplying the work functions. The hydraulic machine 595*b* can be connected to an electric machine 513 and can, in the same way as described previously, function as a hydraulic motor for recovering energy, or as a pump for increasing the pressure of the return flow.

The main pump 205*b* is connected to the driveline 52*b* of the working machine (schematically illustrated in FIG. 6*b*) for transferring a torque to the driveline when recovering energy. Suitably, the driveline has a power take-off (PTO). The power taken off at the PTO can then be used for an optional function of the working machine. The main pump 205*b*, which in this case can operate both as a pump and a hydraulic motor, is adapted to maintain the required pressure on the pressure side at the same time as an excess flow of hydraulic fluid from the recovery unit 595*b* can flow via the conduit 521 and further through the main pump 205*b* and to the tank 243. The main pump, which preferably is a variable load sensing pump of the type "over-centre variable displacement pump", is also mechanically connected to the driveline 52*b*, and can thus be used to generate a torque on the driveline in that hydraulic fluid flows "backwards" through the pump 205*b* to the tank 243. This can be particularly advantageous in operation modes where one or several work functions generate relatively large return flows, at the same time as the flow requirement on the supply side, at the moment in question, is relatively low. Also in case an energy storage connected to the electric machine 513 would be full, there is a possibility to recover energy via the main pump 205*b* instead.

Figure 6:
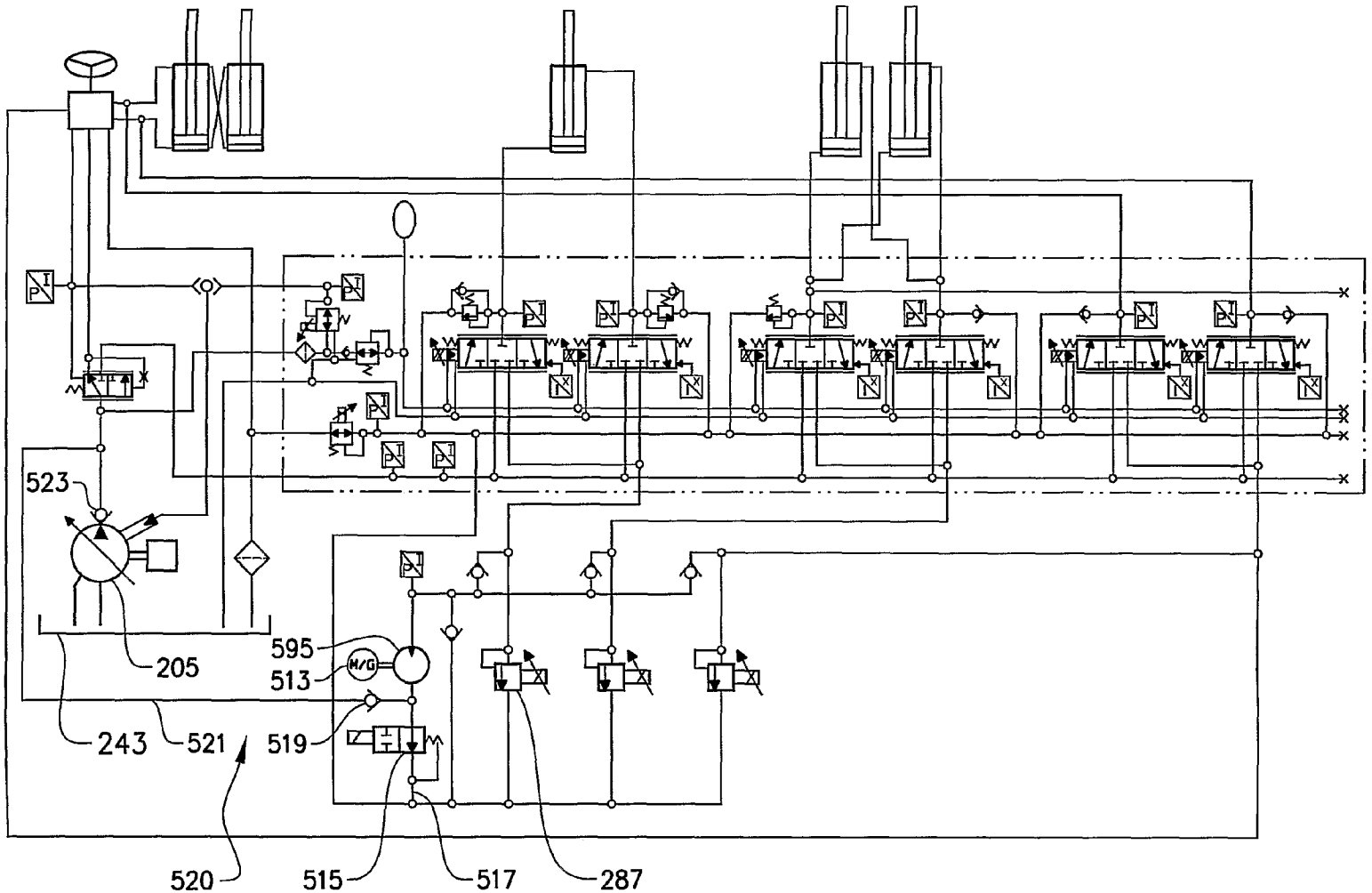
Figure 6B:
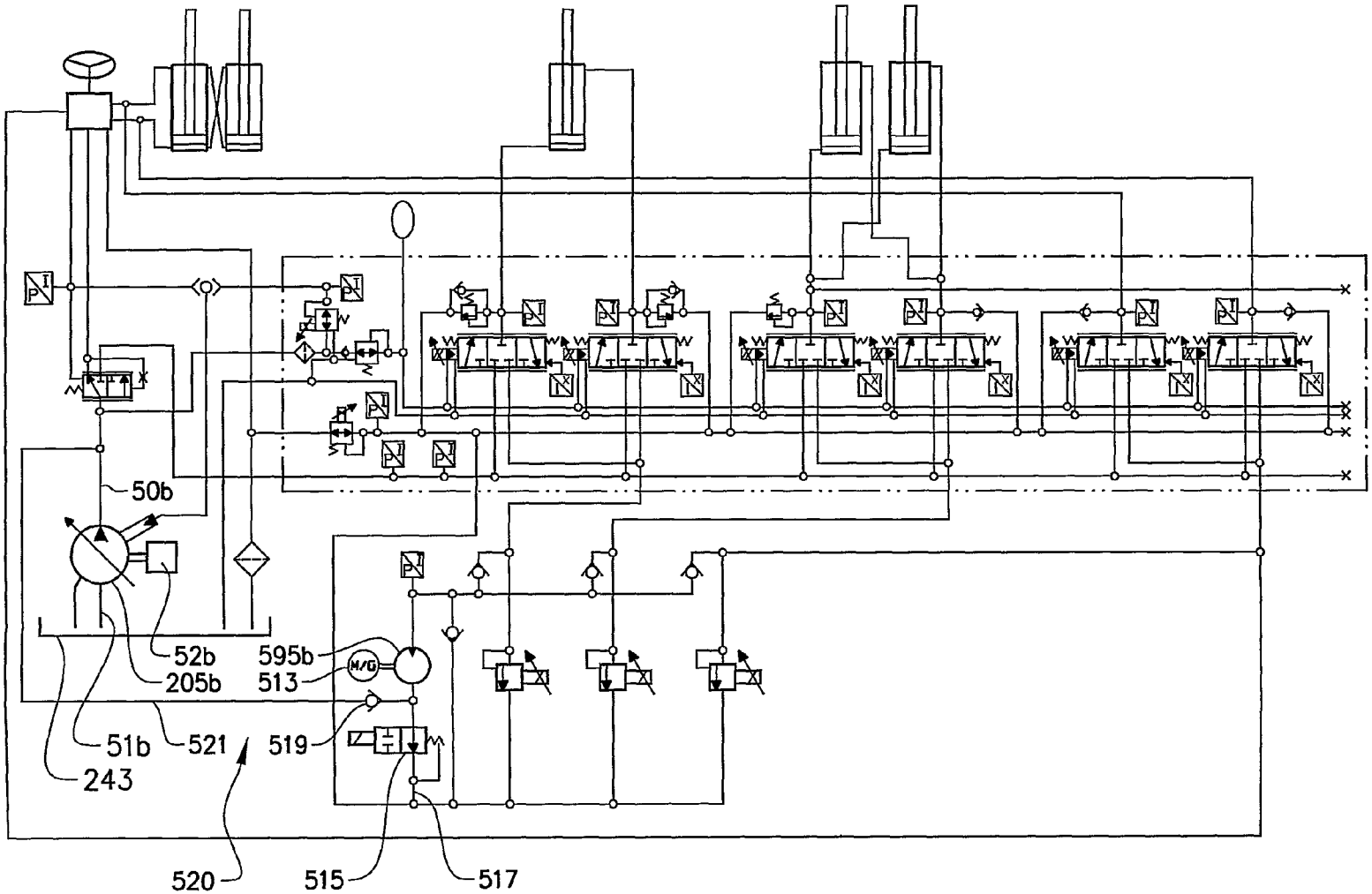

In the following, with reference to FIG. 6, returning of hydraulic fluid from a work function to the pressure side of the main pump will be described with the tilt function as an example.

The pilot-operated valve 287 is controlled so that the required maximum allowable pressure is obtained, which means that the entire return flow of hydraulic fluid from the work function is directed to the hydraulic machine 595. Different strategies can be used depending on the pressure of the return flow relative to the pressure on the pressure side of the main pump:

The Return Pressure is Higher than the Supply Pressure of the Main Pump:

The valve 515 is closed and the entire flow of hydraulic fluid passes via the hydraulic machine 595. The electric machine 513 can recover an amount of energy, i.e. generate electrical power, corresponding to the pressure difference between the return pressure and the supply pressure.

The Return Pressure is Lower than the Supply Pressure of the Main Pump:

The valve 515 is closed and the entire flow of hydraulic fluid passes via the hydraulic machine 595. The electric machine 513 functions as a motor and supplies energy so that the pressure of the return flow can be raised to a level enabling hydraulic fluid to be supplied on the outlet side of the main pump.

If not the entire flow is desired to be returned to the supply line (for example if the return flow is larger than the required supply flow), the following can be done:

The Excess Flow is Dumped to the Tank 243 via the Pilot-Operated Valve 287.

Alternatively, all energy can be stored in an electrical energy storage unit and be consumed later or be used for other electricity consumers.

The recovered energy can be used for different needs. For example, at low diesel engine speeds, the electrical energy can be used to generate higher cylinder speeds in the work functions, or to release more engine power to the driveline.

Figure 7:
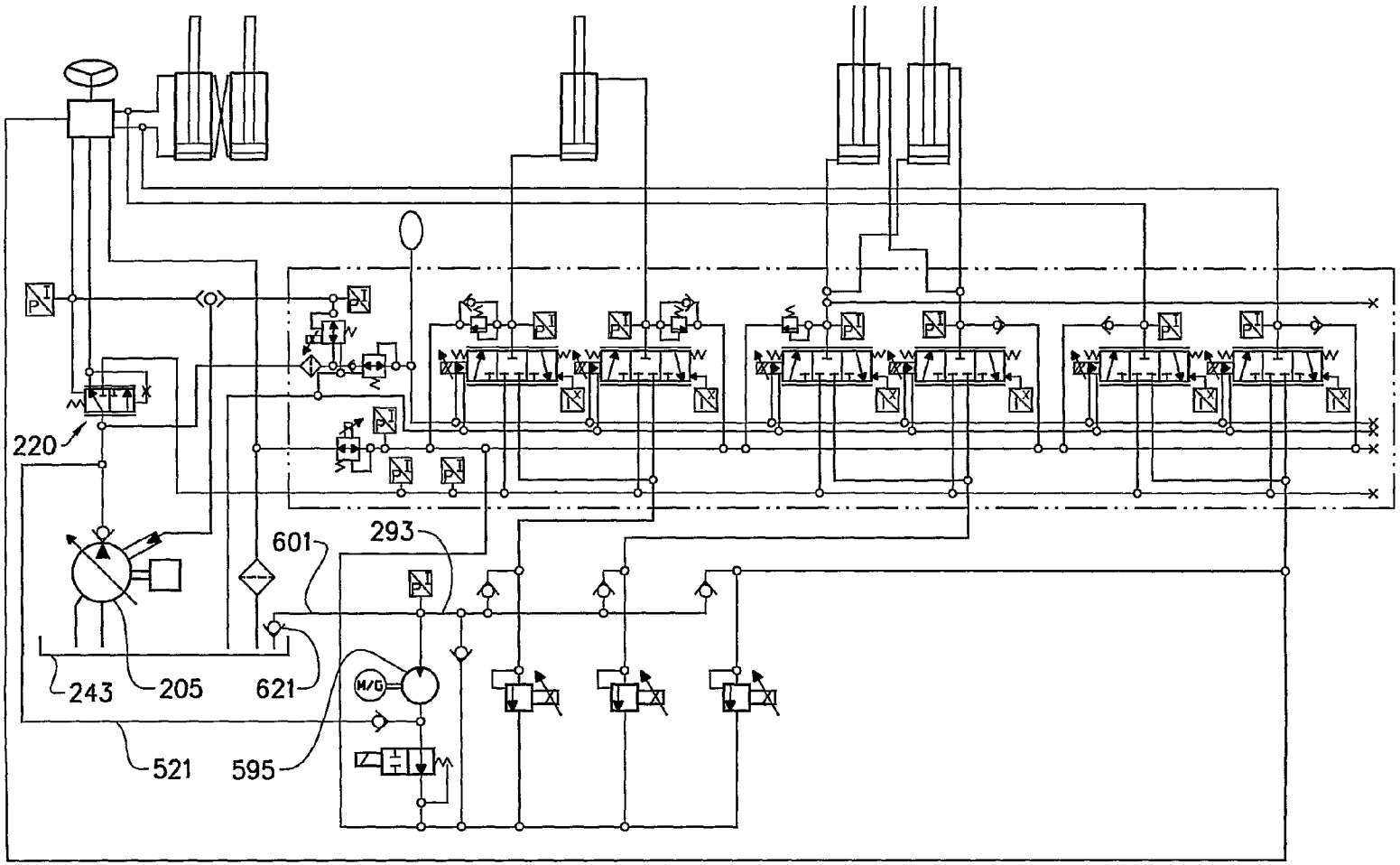

According to a further variant, the recovery unit is used to provide the hydraulic system 201 with a function in the form of a standby steering pump. See FIG. 7. In comparison to the system shown in FIG. 6, a suction conduit 601, enabling the hydraulic machine 595 to draw hydraulic fluid from the tank 243, is added. The suction conduit 601 is preferably adapted to extend from the second conduit 293 to the tank 243 so that the hydraulic machine 595 can draw hydraulic fluid from the tank 243. A check valve 621 can be arranged on the suction conduit 601. By means of the suction conduit 601, the hydraulic machine 595 could deliver hydraulic fluid to the steering system in case the main pump 205, for some reason, would not be capable of providing hydraulic fluid.

According to a further variant, the energy recovery system is used to recover energy during a deceleration of the working machine 101. See FIG. 8. The main pump 205 is drivable by means of the driveline 205*b* of a working machine and is adapted to brake the driveline during deceleration of the working machine. The hydraulic system comprises a hydraulic control means 701*b* for controlling a flow of hydraulic fluid from the pressure side of the pump 205 to the recovery unit 595 to recover energy during deceleration of the working machine. In comparison to the example in FIG. 7, the embodiment of the hydraulic system in FIG. 8 comprises said control means 701*b* in the form of an electrically controlled valve 701 and a conduit 703. The valve 701 is arranged on the conduit 703 connecting the suction conduit 601 and the pump conduit 521. During deceleration of the machine, flow is driven from the pump 205 via the valve 701 to the recovery unit, where the hydraulic energy can be converted into electrical energy for direct consumption or storage in a storage unit. The machine will be decelerated to an extent corresponding to the energy required to drive the pump (and the hydraulic machine and the generator). Adjustment of the deceleration level can, for example, take place by modulating the maximum L S signal to the pump and to thereafter control the electric machine 513 by torque or speed control. The pressure level multiplied by the flow passing the recovery unit corresponds to the deceleration effect which can be achieved. The flow can be determined either by direct speed control of the electric machine, or by controlling the load (torque) which will correspond to a certain speed (and thereby a certain flow). If other functions are supplied simultaneously by the main pump, the electric machine 513 is controlled so that pressure and flow is continuously maintained to these other functions and the remaining part passes to the recovery unit.

Figure 8:
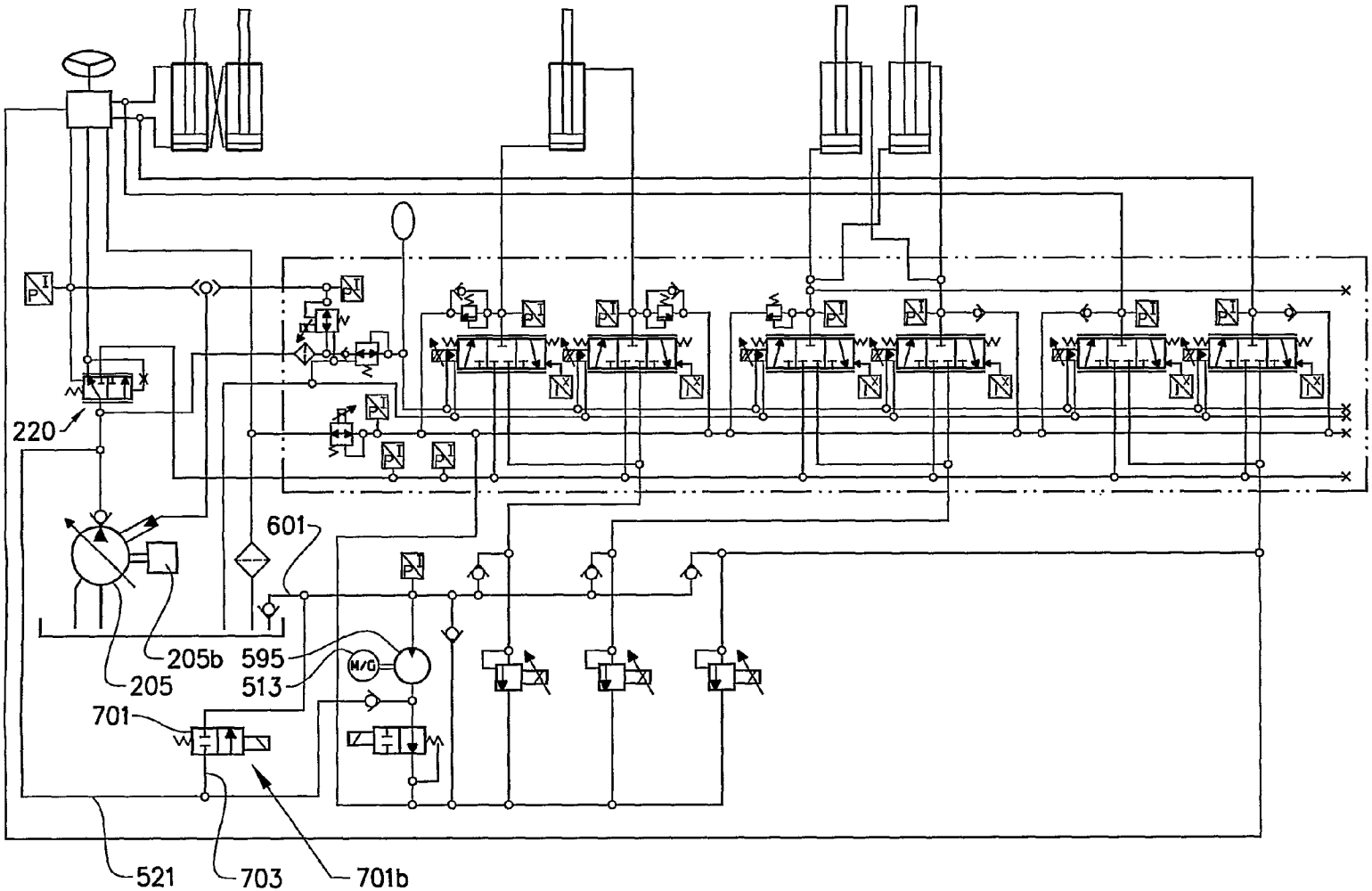
Figure 9:
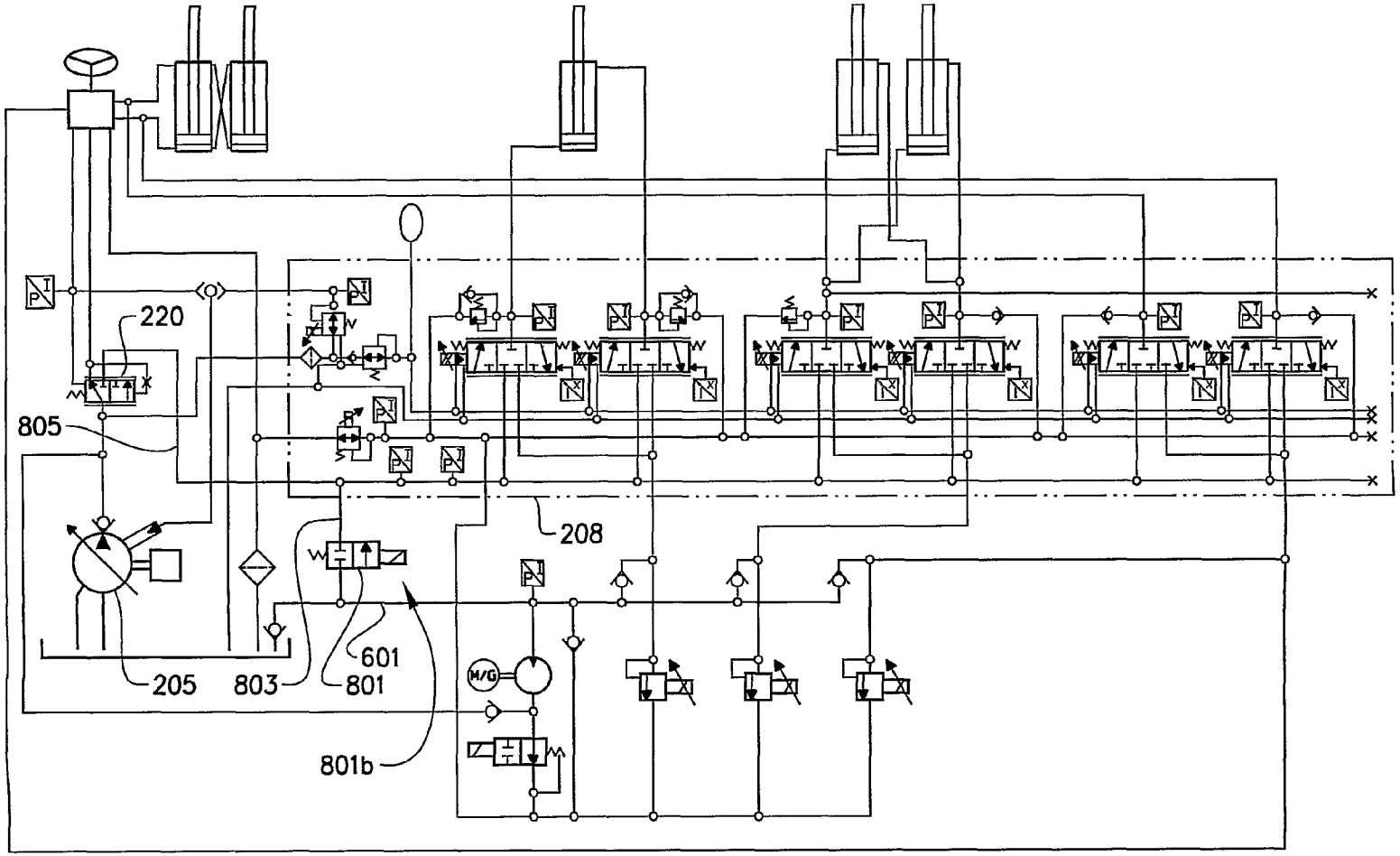

FIG. 9 shows an alternative embodiment to the embodiment in FIG. 8. Here, the control means 801*b* comprises an electrically controlled valve 801 and a conduit 803 connecting the suction conduit 601 and a supply conduit 805. The supply conduit 805 extends from the pump to the prioritizing valve 220 and further to the work functions. The valve 801 is arranged on the conduit 803, which is connected to the supply conduit 805 in a position between the prioritizing valve 220 and the work functions. Thereby, it is ensured that the steering receives flow also in case of a possible malfunction of the recovery unit. In such a case, the prioritizing valve 220 will prioritize a flow from the main pump 205 to the steering at the expense of the supply to the work functions and/or the recovery unit.

Figure 10:
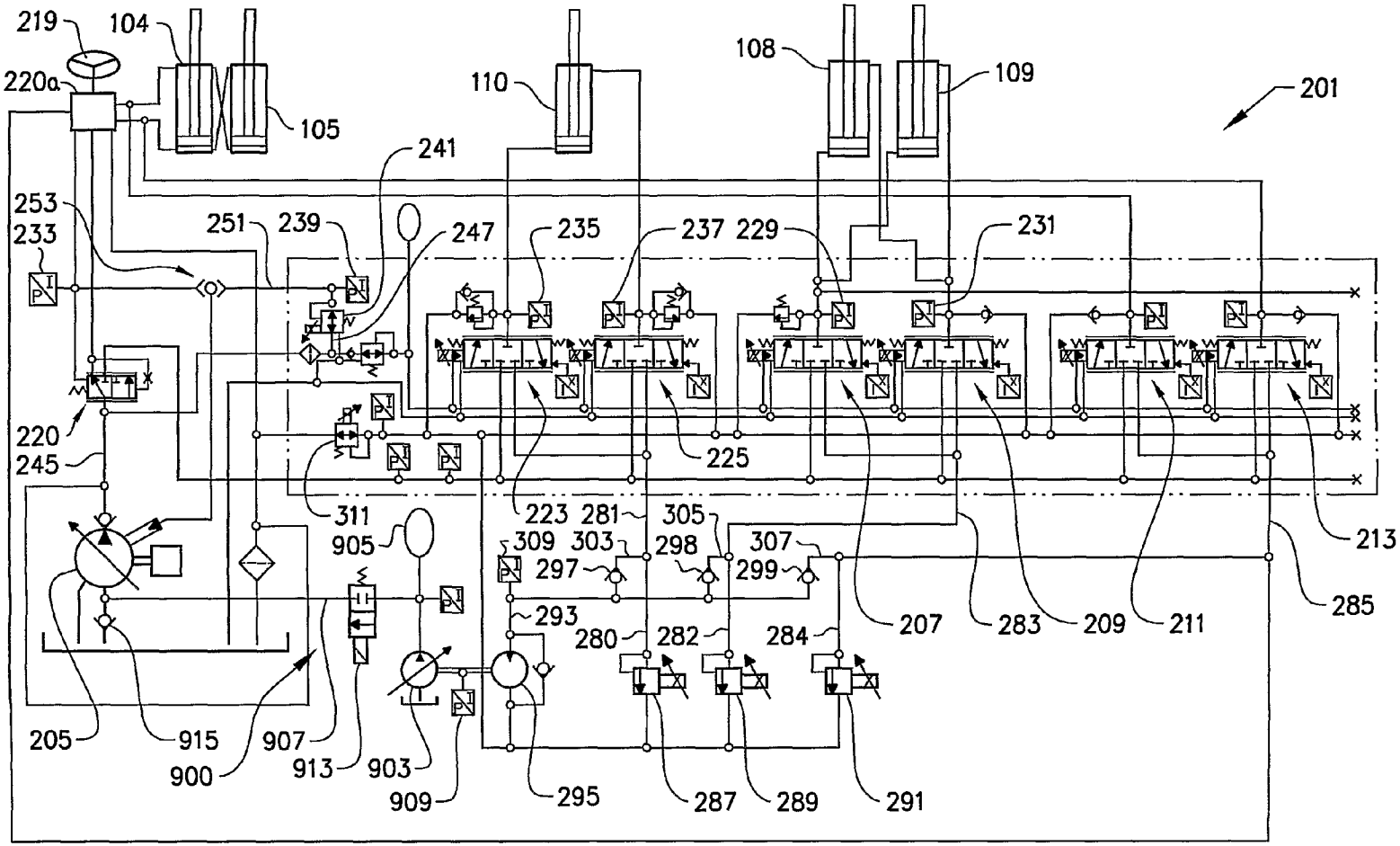
FIG. 10 shows a second example of an energy recovery system.

FIG. 10 shows an alternative embodiment of the hydraulic system according to the invention. The energy recovery system 901 of the hydraulic system is provided in the hydraulic base system 201, which has already been described above with reference to FIGS. 3 and 4. Hereinafter only the differences present in this system in comparison to the energy recovery system in FIGS. 3 and 4 will be described.

In this embodiment, the recovery unit comprises a first hydraulic machine 295 and a second hydraulic machine 903. The first and second hydraulic machine are mechanically interconnected, and the first hydraulic machine 295 is adapted to be driven by a flow of hydraulic flow and the second hydraulic machine 903 is adapted to pump hydraulic fluid by being driven by the first hydraulic machine. Accordingly, instead of the electric machine 313, the energy recovery system 901 comprises said second hydraulic machine 903.

Hereinbelow, the second hydraulic machine 903 will be referred to as a pump and the first hydraulic machine 295 as a hydraulic motor. This arrangement of pump and motor with an intermediate shaft for power transmission forms a hydraulic torque converter. A hydraulic energy storage 905, for example in the form of an accumulator, is connected to an outlet side of the pump 903. The outlet side of the pump 903 is further connected to the hydraulic system 201 via a conduit 907 which is connected to the suction side of the main pump 205. Accordingly, energy stored in the accumulator 905 can be delivered back to the system via the suction side of the main pump 205.

The main pump 205 is preferably mechanically connected to the driveline of the working machine and is driven by the propulsion engine of the working machine, such as a diesel engine. The hydraulic system comprises a means 900 for returning energy, recovered from a return flow from the work function, to the suction side of the pump 205. Hydraulic fluid can be provided from the accumulator 905 to the main pump. Since the hydraulic fluid in the accumulator is pressurized, it can also contribute a torque that drives the main pump 205, which can be utilized to relieve the diesel engine load. Since the accumulator is connected to the suction side of the main pump, all energy stored in the accumulator 905 can be used in the system irrespective of the actual pressure level in the accumulator. In case the accumulator pressure is higher than in the work function which is to be operated, i.e. the pressure in the accumulator 905 is higher than the pressure on the pressure side of the main pump, the excess torque supplied from the accumulator can reduce the torque of the diesel engine. In such a case, the main pump will function as a hydraulic motor supporting the diesel engine.

A description of different ways of using the energy recovery system 901 for recovering energy will follow below.

According to a first variant, energy is recovered when lowering the lift arm assembly 111. (See also FIG. 1.) The control unit registers that the operator wants to lower the lift arm assembly via the lift lever. The control unit sets the pilot-operated valve 289, associated with the lifting cylinders 108, 109, to a maximum allowable pressure, which means that the required pressure for the recovery unit can be achieved, and opens the control valve 207. Hydraulic fluid can now flow from the piston side of the lifting cylinders 108, 109 through the control valve 207, through the check valve 298, and further through the hydraulic motor 295 and then further to the tank 243 via the counterpressure valve 311. The piston rod side of the lifting cylinders 108, 109 is replenished in a conventional manner by means of the anticavitation valves arranged in the control valve unit.

The pump 903, driven by the hydraulic motor 295, delivers pressurized hydraulic fluid to the accumulator 905. The pressure of the return flow passing through the motor 295 depends on the pressure in the hydraulic cylinder (which in its turn depends on the actual load). The pressure on the pressure side of the pump 903 is dependent on how much the gas in the accumulator 905 is compressed. This means that the pressure in the accumulator 905 and the pressure of the hydraulic fluid before the hydraulic motor 295 are essentially never equal. By using the hydraulic torque converter, all recovered energy can be taken care of in the accumulator 905, irrespective of pressure levels.

If the motor 903 operates at a high pressure and the accumulator 905 has a low pressure, a calculation of which displacement the pump 903 should be set to in order to obtain the same torque can be performed (the torque is proportional to the displacement multiplied by the pressure). In practice, this means that the pump 903 pushes hydraulic fluid into the accumulator 905 with a larger flow and a lower pressure in comparison to the hydraulic motor 295, but that the energy stored in the accumulator 905 substantially corresponds to the one developed in the hydraulic motor. Alternatively, both the control valve 207 and control valve 209 can open the outlet to the recovery unit, which means that both the piston side and the piston rod side are connected to the recovery unit. This, in its turn, will result in a reduced return flow to the recovery unit (but a higher pressure), since the lowering operation will be carried out primarily by hydraulic fluid flowing from the piston side to the piston rod side. This can be used, for example, when the bucket is empty and a rapid lowering is to take place without risking overspeeding the hydraulic motor 295.

Different Control Options can be Used:

No Recovery:

The entire return flow passes through the pilot-operated valve 289, which is set to generate a minimum back pressure. The control of the magnitude of the return flow occurs by means of the control valve 207 according to the desired lowering speed of the lift arm assembly. The flow can be calculated on the basis of slide position and pressure drop across the slide of the control valve 207. Pressure sensors on the piston side of the hydraulic cylinder and the pressure sensor 309 at the recovery unit can be utilized. The reason which energy is not desired to be recovered can, for example, be because the accumulator 905 is fully charged, i.e. that the pressure in the accumulator has reached a maximum level. It can also be because the lift arm assembly is desired to be lowered with maximum force (through pushing by pumping force), and in such a case a back pressure in the return line would counteract the lowering movement.

Full Recovery:

The pilot-operated valve 289 is controlled so that a suitable maximum allowable pressure is obtained, which means that all flow passes through the hydraulic motor 295. The control of the magnitude of the return flow occurs by means of the control valve 207. The control unit has information about the pressure on the piston side of the hydraulic cylinder and preferably opens the control valve 207 as much as possible. A calculation of how high a back pressure should prevail after the control valve 207 in order to obtain the requested flow can be performed. The pressure can be measured by the pressure sensor 309.

For the hydraulic motor 295, it applies that Mut=Displ*Pressure drop*ηhm/(2*PI). For the pump 903, it applies that Min=Displ*Pressure drop/(ηhm*2*PI). By means of input data regarding pressure, efficiencies and motor displacement, a determination of the setting of the required displacement of the pump 903 can be calculated. The pump is then controlled according to the calculated value. Furthermore, a fine tuning of the displacement can be performed after verifying the actual pressure measured by the pressure sensor 309. A repeated calculation and modulation of the displacement are performed continuously, since the pressure varies in the accumulator 905 and on the piston side of the hydraulic cylinder.

Partial Recovery:

If only a certain part of the energy can be recovered, a calculation and modulation of the desired torque are performed by adjusting the displacement of the pump 903. This corresponds to a certain pressure in a position between the control valve and the hydraulic motor, i.e. at the pressure sensor 309. A sensor 909 is adapted to sense the speed on the shaft connecting the hydraulic motor 295 to the pump 903. With information from the speed sensor 909, it can be verified that the hydraulic motor 295 and the pump 903 are not overspeeding. The pilot-operated valve 289 can then adjust the maximum allowable pressure at the return port to a value such that overspeeding cannot arise. Accordingly, a flow of hydraulic fluid can be by-passed directly to the tank 243 via the pilot-operated valve. The control valve 207 is adjusted in a conventional manner so that the correct cylinder speed is obtained.

Combined recovery:

It is possible to switch between the above control options (No, Full and Partial recovery) during one and the same lowering event. For example, at the beginning of a lowering movement, partial recovery can be applied in case the pressure in the accumulator 905 is low. Thereafter, full recovery is performed and after the accumulator 905 has reached maximum pressure no recovery takes place.

According to a further variant, energy is recovered when emptying the bucket (tilt-out). Recovery when emptying the bucket takes place in a corresponding manner as when lowering the lift arm assembly.

According to a further variant, energy is recovered when steering with the steering lever. Energy recovery during lever steering by means of a system according to the embodiment in FIG. 10 takes place in substantially the same manner as for energy recovery during lever steering by means of the system according to the embodiment in FIG. 4, with some differences:

In the case "Full recovery", the biasing pressure is controlled by adjusting the torque on the pump 903 (according to the previous description).

According to a further variant, energy is recovered when steering with the steering wheel (via orbitrol unit). Energy recovery during steering wheel steering by means of a system according to the embodiment in FIG. 10 takes place in substantially the same manner as for energy recovery during steering wheel steering by means of the system according to the embodiment in FIG. 4, with some differences:

In the case "No recovery", the displacement of the pump 903 is controlled to a (maximum) level, so that the load on the hydraulic motor becomes so large than flow cannot pass via the hydraulic motor 295.

Figure 11:
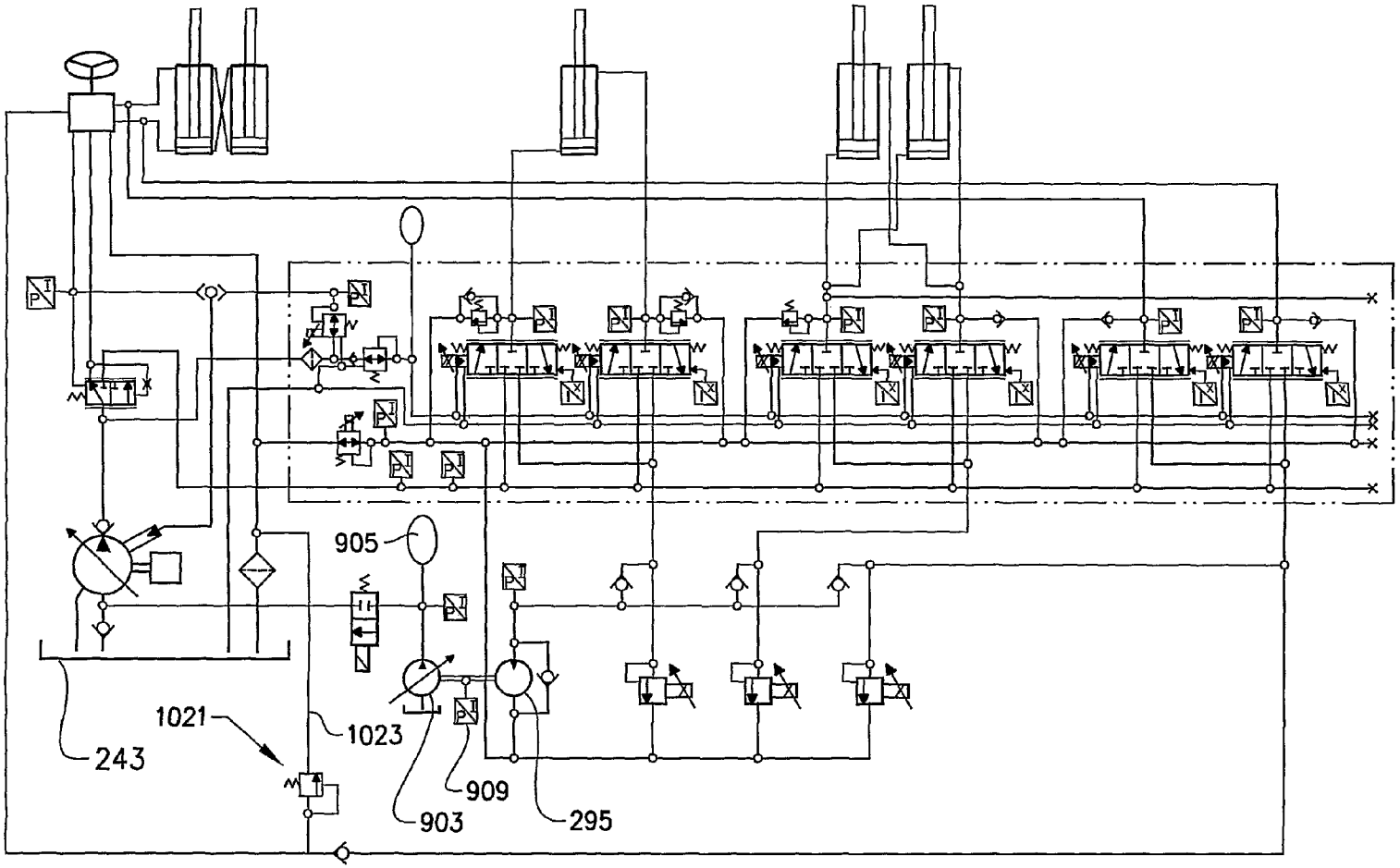
FIGS. 11-13 show different variants of the second example of the energy recovery system.

FIG. 11 shows a further development of the embodiment in FIG. 9. (This further development corresponds to the further development in FIG. 5 of the hydraulic system in FIG. 4.) A pressure limiter 1021 is arranged on a conduit 1023 connecting the return conduit from the lever steering to the tank 243.

According to a further variant, energy is recovered when several work functions are used simultaneously, This works in substantially the same way as described above for the hydraulic system shown in FIG. 4.

According to a further variant, the hydraulic system is used as an active suspension system for a work function, such as for example the lift function, where the undesired kinetic energy of the machine body and/or the work implement is at least partially recovered. This in a corresponding way as described above for the hydraulic system in FIG. 4, with some differences:

The pump 903 preferably has a torque control, i.e. the load from the pump on the hydraulic motor can be increased until the lifting assembly stops because the back pressure from the hydraulic motor is sufficiently large. The piston stroke length and piston speed of the hydraulic cylinder will depend on the selected torque control strategy. The pilot-operated valve 289 is controlled to set a maximum allowable pressure which means that the recovery unit can operate at the desired pressure level within the range of the maximum pressure.

In case only a limited energy recovery can be performed, a certain deceleration of the movement of the work implement can occur by means of the control valve 207 and bypassing of hydraulic fluid can occur via the pilot-operated valve 289.

According to a further variant, the hydraulic system is used to obtain energy recovery during a deceleration of the working machine 101. See FIG. 12. In comparison to the embodiment in FIG. 11, an electrically controlled valve 1101 is arranged also on a conduit 1103 connecting the second conduit 293 of the recovery system and the tank 243.

During deceleration the working machine, the main pump 205 is driven by the driveline at the same time as the main pump 205 brakes the driveline. Thereby, the main pump pumps a flow of hydraulic fluid via the valve 1101 to the recovery unit. The working machine is decelerated to an extent corresponding to the energy required to drive the main pump 205 (and the recovery unit). During deceleration, the valve 1101 is preferably kept fully open. Adjustment of the deceleration level can take place by calculating and adjusting the L S signal to the main pump (since the L S signal constitutes a reference signal for the pressure regulator of the pump), and adjustment of the displacement of the pump 903. The flow can be calculated with input data from the speed sensor 909. The deceleration effect is proportional to the pressure multiplied by the flow.

Energy can be recovered from the deceleration, at the same time as other work functions are used. If other work functions are used simultaneously, the L S signal to the main pump is determined by the highest pressure of the pressure required for the other work functions and the pressure required to obtain the desired deceleration effect (deceleration energy). Calculation of how much energy can be recovered is performed and the displacement of the pump 903 is adjusted accordingly. The flow across the hydraulic motor 295 is calculated (by means of the speed sensor 909) and the flow going out to other work functions is calculated (by means of slide position and pressure drop of associated control valves). If steering wheel steering with orbitrol unit is used, for example, a steering position sensor can be used to calculate the flow to the steering. If the recovery unit cannot receive a pressure and/or flow corresponding to the required amount of deceleration energy, a certain amount of energy can be dumped by controlling the control valve 1101 so that a corresponding pressure drop arises across it.

Figure 12:
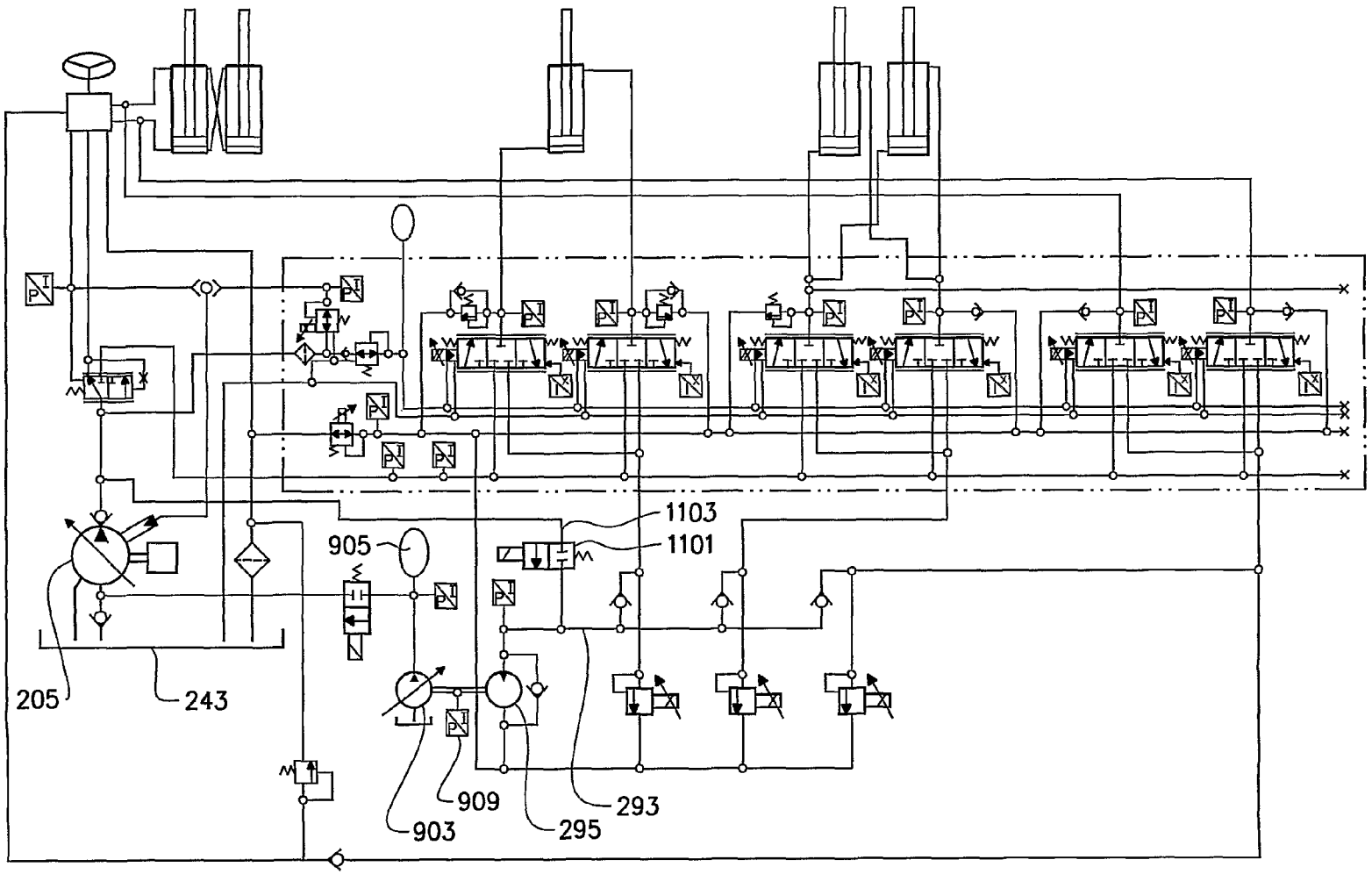
Figure 13:
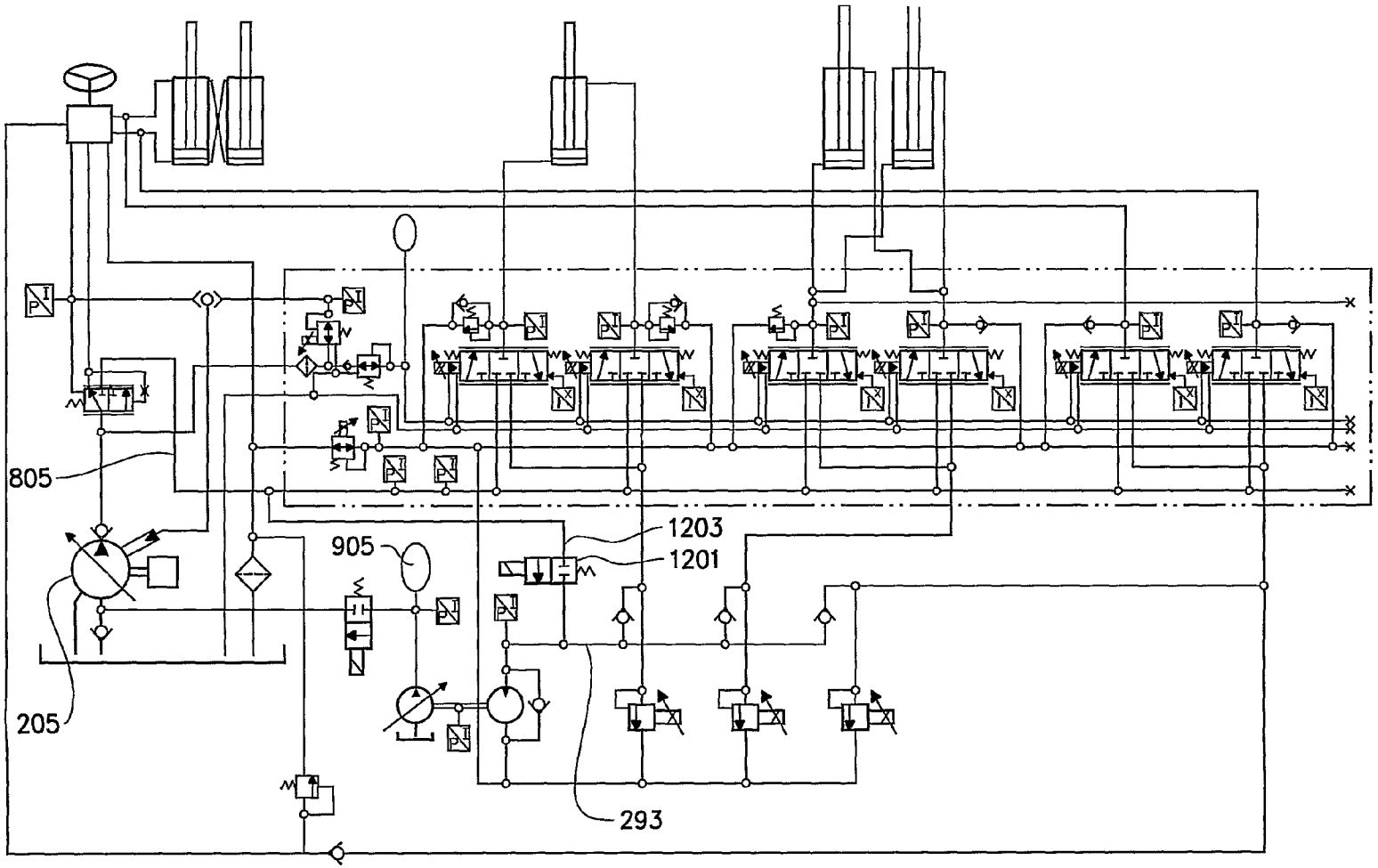

FIG. 13 shows an alternative embodiment to the embodiment in FIG. 12. Here, the electrically control valve 1201 is arranged on a conduit 1203 connecting the second conduit 293 in the recovery system to a supply conduit 805 arranged between the main pump 205 and the work functions. The conduit 1203 is connected to the supply conduit 805 in a position between the prioritizing valve 220 and the work functions. Thereby, it is ensured that the steering receives a flow also in case of a possible malfunction of the recovery unit. In such a case, the prioritizing valve 220 will prioritize a flow from the main pump 205 to the steering at the expense of the supply to the work functions and/or the recovery unit.

According to a further variant, the hydraulic system is used to supply recovered energy from an accumulator to the main pump.

Using energy stored in an accumulator directly for a work function normally results in large losses. The pressure in the accumulator is dependent on how much the gas is compressed, and the pressure required by the hydraulic cylinder depends on the actual load situation. Either the pressure in the accumulator is lower than the pressure requirement of the hydraulic cylinder, which will mean that the hydraulic cylinder does not move at all, or the pressure in the accumulator is higher than the pressure requirement of the hydraulic cylinder, which means that energy has to be throttled away via a valve to enable the speed of the hydraulic cylinder piston to be controlled.

However, through this variant of the hydraulic system according to the invention, substantially all energy stored in the accumulator 905 can be recovered. See FIG. 10.

The accumulator 905 is connected to the suction side of the pump 205 via the valve 913. A check valve 915 on a conduit between the main pump 205 and the tank 243 prevents the pressurized oil from the accumulator 905 from passing to the tank 243. When the valve 913 is closed, the main pump draws oil in a conventional manner from the tank. The power required to drive the pump is proportional to the pressure difference between pressure and suction side of the pump multiplied by the flow through the pump. When the valve 913 is opened, the pressure in the accumulator is supplied to the suction side of the pump, which reduces the pressure difference between pressure and suction side of the pump 205. If the pressure in the accumulator is equal to the output pressure, virtually no energy has to be supplied from the diesel engine to drive the pump (with the exception of some energy consumption due to slip losses). In case the pressure in the accumulator 905 is lower than the output pressure from the main pump 205, only a power which increases the pressure prevailing in the accumulator 905 to the requested pressure on the pressure side of the pump is needed from the diesel engine. In case the pressure is higher in the accumulator 905 than the desired pressure on the pressure side, the main pump 205 will act as a hydraulic motor and drive the diesel engine and its auxiliary equipment.

In the description above, the term "electrically controlled valve" has been used for a direct electrically controlled valve in a hydraulic conduit, that is to say the valve is adapted to be controlled via an input electrical signal. There are of course variants of this within the scope of the term "electrically controlled valve", such as an arrangement of several valves, out of which a first valve is arranged on the hydraulic conduit and a second direct electrically controlled valve is adapted to control the first valve via a hydraulic signal.

The invention claimed is:

1. A hydraulic system for a working machine, comprising at least one work function and a control valve unit for controlling hydraulic fluid to and from the work function, and a recovery unit connected to a return port of the control valve unit for recovering energy from the work function, and a means for limiting the pressure of the hydraulic fluid at the return port, wherein the pressure limiting means comprises a pilot-operated valve arranged to set a maximum allowable pressure at the return port of the control valve unit, which pressure is variable by controlling the pilot-operated valve by means of a control unit, wherein the maximum allowable pressure at the return port of the control valve unit is continuously variable by means of the pilot-operated valve.

2. The hydraulic system according to claim 1, wherein the pilot-operated valve is connected to the return port and connected in parallel with the recovery unit.

3. The hydraulic system according to claim 1, wherein the pilot-operated valve is electrically controllable.

4. The hydraulic system according to claim 1, wherein the system comprises a pump for providing hydraulic fluid.

5. The hydraulic system according to claim 4, wherein the pump is adapted to provide hydraulic fluid to the at least one work function.

6. The hydraulic system according to claim 5, wherein the system comprises a means for returning energy, recovered from a return flow from the work function, to the pressure side of the pump.

7. The hydraulic system according to claim 6, wherein the pump is adapted to function both as a pump and a hydraulic motor, and the pump is adapted to provide a torque when hydraulic fluid flows from the recovery unit to the pressure side of the pump and further through the pump to the suction side of the pump, at the same time as the pump provides a required pressure on the pressure side for supplying the work function.

8. The hydraulic system according to claim 5, wherein the system comprises a means for returning energy, recovered from a return flow from the work function, to the suction side of the pump.

9. The hydraulic system according to claim 4, wherein the pump is drivable by the driveline of a working machine and is adapted to brake the driveline during deceleration of the working machine, and the system comprises a hydraulic control means for controlling a flow of hydraulic fluid, from the pressure side of the pump to the recovery unit, for recovering energy during deceleration of the working machine.

10. The hydraulic system according to claim 1, wherein the recovery unit comprises a first hydraulic machine and a second hydraulic machine, and the first and second hydraulic machine are mechanically interconnected, and the first hydraulic machine is adapted to be driven by a flow of hydraulic fluid and the second hydraulic machine is adapted to pump hydraulic fluid by being driven by the first hydraulic machine.

11. The hydraulic system according to claim 10, wherein the first hydraulic machine is connected to the return port to be driven by a return flow, and the second hydraulic machine is adapted to pump hydraulic fluid to an accumulator.

12. The hydraulic system according to claim 10, wherein the pump is adapted to provide hydraulic fluid to the at least one work function, and the first hydraulic machine is connected to the return port to be driven by a return flow, and the second hydraulic machine is adapted to pump hydraulic fluid to the pressure side of the pump.

13. The hydraulic system according to claim 10, wherein the pump is adapted to provide hydraulic fluid to the at least one work function, and the first hydraulic machine is connected to the return port to be driven by a return flow, and the second hydraulic machine is adapted to pump hydraulic fluid to the suction side of the pump.

14. The hydraulic system according to claim 1, wherein the at least one work function comprises a hydraulic cylinder provided with a piston for transferring power to a machine component in a working machine.

15. The hydraulic system according to claim 14, wherein the control valve unit is adapted to control a return flow of hydraulic fluid, optionally from the piston side of the hydraulic cylinder and/or the piston rod side of the hydraulic cylinder, to the recovery unit.

16. The hydraulic system according to claim 14, wherein the system comprises a pressure sensor adapted to measure the pressure of the hydraulic fluid on the piston side of the hydraulic cylinder.

17. The hydraulic system according to claim 14, wherein the system comprises a pressure sensor adapted to measure the pressure of the hydraulic fluid on the piston rod side of the hydraulic cylinder.

18. The hydraulic system according to claim 1, wherein the recovery unit is adapted to dampen a relative movement caused by an external disturbance, at least in one direction, between a work implement and a machine body of the working machine, which work implement is moveable relative to the machine body by means of the work function.

19. The hydraulic system according to claim 18, wherein the system comprises a sensor for determining a reference position for the work implement relative to the machine body.

20. The hydraulic system according to claim 1, wherein the system comprises a plurality of work functions with an associated respective control valve unit, and one the pilot-operated valve is provided for the respective work function.

21. The hydraulic system according to claim 20, wherein the system comprises a check valve which is connected in series with the recovery unit in a position between the return port of the control valve unit and the recovery unit, and the check valve is connected in parallel with the pilot-operated valve in order to block flow in a direction toward the work function, and the system comprises one the check valve arranged for a respective pilot-operated valve, which check valve is connected in series with the recovery unit in a position between the return port of the respective control valve unit and the recovery unit, and connected in parallel with the pilot-operated valve, in order to block flow in a direction toward the respective work function.

22. The hydraulic system according to claim 21, wherein the outlets of the check valves are interconnected upstream of the recovery unit.

23. The hydraulic system according to claim 22, wherein the system comprises a pressure sensor adapted to measure the pressure of the hydraulic fluid in a position located downstream of the check valves and upstream of the recovery unit.

24. The hydraulic system according to claim 20, wherein the system comprises a pressure sensor for the respective pilot-operated valve adapted to measure the pressure of the hydraulic fluid in a position located between the return port of the respective control valve unit and the inlet port of the respective pilot-operated valve.

25. The hydraulic system according to claim 20, wherein the system comprises one the recovery unit for the respective work function.

26. The hydraulic system according to claim 20, wherein the system comprises a control unit for individual control of the pilot-operated valves.

27. A working machine comprising a hydraulic system according to claim 1.

28. A hydraulic system for a working machine, comprising at least one work function and a control valve unit for controlling hydraulic fluid to and from the work function, and a recovery unit connected to a return port of the control valve unit for recovering energy from the work function, and a means for limiting the pressure of the hydraulic fluid at the return port, wherein the pressure limiting means comprises a pilot-operated valve arranged to set a maximum allowable pressure at the return port of the control valve unit, which pressure is variable by controlling the pilot-operated valve by means of a control unit, wherein the system comprises a check valve which is connected in series with the recovery unit in a position between the return port of the control valve unit and the recovery unit, and the check valve is connected in parallel with the pilot-operated valve in order to block flow in a direction toward the work function.

29. A hydraulic system for a working machine, comprising at least one work function and a control valve unit for controlling hydraulic fluid to and from the work function, and a recovery unit connected to a return port of the control valve unit for recovering energy from the work function, and a means for limiting the pressure of the hydraulic fluid at the return port, wherein the pressure limiting means comprises a pilot-operated valve arranged to set a maximum allowable pressure at the return port of the control valve unit, which pressure is variable by controlling the pilot-operated valve by means of a control unit, wherein the system comprises a pressure sensor adapted to measure the pressure of the hydraulic fluid in a position located between the return port of the control valve unit and the inlet port of the pilot-operated valve.

30. A method for recovering energy in a hydraulic system, wherein the hydraulic system comprises at least one work function and a control valve unit for controlling hydraulic fluid to and from the work function, and a recovery unit connected to a return port of the control valve unit for recovering energy from the work function, comprising continuously controlling a maximum allowable pressure at the return port by a pressure limiting means through receiving signals from a control unit to adapt a maximum energy recovery rate of the recovery unit to an actual operation mode of the work function.

* * * * *